US009293076B2

(12) United States Patent
Chan et al.

(10) Patent No.: US 9,293,076 B2
(45) Date of Patent: Mar. 22, 2016

(54) DOT INVERSION CONFIGURATION

(71) Applicant: QUALCOMM MEMS Technologies, Inc., San Diego, CA (US)

(72) Inventors: Edward Keat Leem Chan, San Diego, CA (US); Bing Wen, Poway, CA (US); Cheonhong Kim, San Diego, CA (US); Wilhelmus Johannes Robertus Van Lier, San Diego, CA (US); Chih-Hsiang Ho, Lafayette, IN (US); Rihui He, San Jose, CA (US); Ming-Hau Tung, San Francisco, CA (US); Alok Govil, Fremont, CA (US); Jae Hyeong Seo, Pleasanton, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 155 days.

(21) Appl. No.: 14/059,320

(22) Filed: Oct. 21, 2013

(65) Prior Publication Data

US 2015/0109265 A1 Apr. 23, 2015

(51) Int. Cl.
*G09G 3/20* (2006.01)
*G09G 3/34* (2006.01)

(52) U.S. Cl.
CPC ..... *G09G 3/20* (2013.01); *G09G 3/3466* (2013.01); *G09G 2300/0404* (2013.01); *G09G 2300/0426* (2013.01); *G09G 2300/08* (2013.01); *G09G 2300/0823* (2013.01); *G09G 2310/0256* (2013.01); *G09G 2320/0247* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 6,201,522 | B1 | 3/2001 | Erhart et al. | |
| 7,675,498 | B2 | 3/2010 | Ku | |
| 8,035,610 | B2 | 10/2011 | Hsu | |
| 2008/0024408 | A1 | 1/2008 | Sano et al. | |
| 2009/0237339 | A1 * | 9/2009 | Pai | G09G 3/3614 345/90 |
| 2010/0207861 | A1 * | 8/2010 | Chang | G09G 3/3614 345/90 |
| 2013/0021303 | A1 * | 1/2013 | Martin et al. | 345/178 |
| 2013/0135326 | A1 * | 5/2013 | Govil | G09G 3/3466 345/520 |

OTHER PUBLICATIONS

International Search Report and Written Opinion—PCT/US2014/059705—ISA/EPO—Dec. 12, 2014.

* cited by examiner

*Primary Examiner* — Kenneth B Lee, Jr.
(74) *Attorney, Agent, or Firm* — Weaver Austin Villeneuve & Sampson LLP

(57) ABSTRACT

This disclosure provides systems, methods and apparatus for an arrangement of pixels and interconnects in a display. In one aspect, polarities of pixels may be in a dot inversion configuration, or checkerboard pattern, to reduce the visibility of flicker. Various interconnect alternatively couple between modules in different columns or rows to provide dot inversion.

17 Claims, 20 Drawing Sheets

DOT INVERSION CONFIGURATION

TECHNICAL FIELD

This disclosure relates to electromechanical systems and devices. More specifically, the disclosure relates to an arrangement of pixels and interconnects in a display, such as a display using an interferometric modulator (IMOD).

DESCRIPTION OF THE RELATED TECHNOLOGY

Electromechanical systems (EMS) include devices having electrical and mechanical elements, actuators, transducers, sensors, optical components such as mirrors and optical films, and electronics. EMS devices or elements can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

One type of EMS device is called an interferometric modulator (IMOD). The term IMOD or interferometric light modulator refers to a device that selectively absorbs and/or reflects light using the principles of optical interference. In some implementations, an IMOD display element may include a pair of conductive plates, one or both of which may be transparent and/or reflective, wholly or in part, and capable of relative motion upon application of an appropriate electrical signal. For example, one plate may include a stationary layer deposited over, on or supported by a substrate and the other plate may include a reflective membrane separated from the stationary layer by an air gap. The position of one plate in relation to another can change the optical interference of light incident on the IMOD display element. IMOD-based display devices have a wide range of applications, and are anticipated to be used in improving existing products and creating new products, especially those with display capabilities.

Electric charge may accumulate throughout a device when an electric field is applied. For example, charge may accumulate on the various parts of a display element, such as an IMOD or a liquid crystal display (LCD). In some implementations, the accumulation of charge may affect the performance of the display element.

Polarity inversion may be used to periodically reverse electric fields and maintain a balance of charge, and therefore, reduce the accumulation of charge.

SUMMARY

The systems, methods and devices of this disclosure each have several innovative aspects, no single one of which is solely responsible for the desirable attributes disclosed herein.

One innovative aspect of the subject matter described in this disclosure can be implemented in a circuit including an array of display units comprising a first three-terminal display unit having a first terminal, and a second terminal, and a third terminal, the first terminal coupled to a first interconnect, the second terminal coupled to a second interconnect, and the third terminal coupled to a seventh interconnect; a second three-terminal display unit having a first terminal and, a second terminal, and a third terminal, the first terminal coupled to a third interconnect, the second terminal coupled to a fourth interconnect, and the third terminal coupled to the seventh interconnect; a third three-terminal display unit having a first terminal, and a second terminal, and a third terminal, the first terminal coupled to a fifth interconnect, the second terminal coupled to the fourth interconnect, and the third terminal coupled to the seventh interconnect; and a fourth three-terminal display unit having a first terminal, and a second terminal, and a third terminal, the first terminal coupled to the first interconnect, the second terminal coupled to a sixth interconnect, and the third terminal coupled to the seventh interconnect.

In some implementations, the seventh interconnect is configured to provide a fixed voltage.

In some implementations, the first interconnect, the third interconnect, and the fifth interconnect are in a first orientation, and the second interconnect, the fourth interconnect, and the sixth interconnect are in a second orientation.

In some implementations, the first and fourth display units are at a first polarity, and the second and third display units are at a second polarity opposing the first polarity.

In some implementations, the first and fourth display units are configured to switch to the second polarity, and the second and third display units are configured to switch to the first polarity.

In some implementations, the circuit can include an eighth interconnect coupled to a control terminal of a first switch associated with the first display unit, and further coupled to a control terminal of a second switch associated with the second display unit; and a ninth interconnect coupled to a control terminal of a third switch associated with the third display unit, and further coupled to a control terminal of a fourth switch associated with the fourth display unit.

In some implementations, the circuit can include an eighth interconnect coupled to a control terminal of a first switch associated with the second display unit; a ninth interconnect coupled to a control terminal of a second switch associated with the first display unit and, the eighth interconnect also being coupled to a control terminal of a third switch associated with the fourth display unit; and a tenth interconnect coupled to a control terminal of a fourth switch associated with the third display unit.

In some implementations, the first display unit is positioned in a first row of the array of display unit, and the fourth display unit is positioned in a second row.

In some implementations, the three-terminal display units are interferometric modulators (IMODs).

In some implementations, the first display unit and the second display unit are positioned in a first row of the array of display units, and wherein the third display unit and the fourth display unit are positioned in a second row.

In some implementations, the first display unit and the third display unit are positioned in a first column, and the second display unit and the fourth display unit are positioned in a second column.

Another innovative aspect of the subject matter described in this disclosure can be implemented in circuit including an array of display units comprising a first three-terminal display unit having a first terminal, and a second terminal, and a third terminal, the first terminal coupled to a first interconnect, the second terminal coupled to a second interconnect, and the third terminal coupled to a seventh interconnect; a second three-terminal display unit having a first terminal and, a second terminal, and a third terminal, the first terminal coupled to a third interconnect, the second terminal coupled to a fourth interconnect, and the third terminal coupled to an eighth interconnect; a third three-terminal display unit having a first terminal, and a second terminal, and a third terminal, the first terminal coupled to a fifth interconnect, the second terminal coupled to the fourth interconnect, and the third terminal coupled to the eighth interconnect; and a fourth three-terminal display unit having a first terminal, and a second terminal, and a third terminal, the first terminal coupled to the first interconnect, the second terminal coupled to a sixth interconnect, and the third terminal coupled to the seventh interconnect.

In some implementations, the first and fourth display units are at a first polarity, and the second and third display units are at a second polarity opposing the first polarity.

In some implementations, the circuit can include a ninth interconnect coupled to a control terminal of a first switch associated with the first display unit, and further coupled to a control terminal of a second switch associated with the second display unit; and a tenth interconnect coupled to a control terminal of a third switch associated with the third display unit, and further coupled to a control terminal of a fourth switch associated with the fourth display unit.

Another innovative aspect of the subject matter described in this disclosure can be implemented in a method for inverting polarities of display units in an array of display units. In some implementations, a first group of display units in the array of display units can be provided with a voltage having a first polarity. A second group of display units in the array of display units can be provided with a voltage having a second polarity. The array of display units can include a first three-terminal display unit having a first terminal, and a second terminal, and a third terminal, the first terminal coupled to a first interconnect, the second terminal coupled to a second interconnect, and the third terminal coupled to a seventh interconnect; a second three-terminal display unit having a first terminal and, a second terminal, and a third terminal, the first terminal coupled to a third interconnect, the second terminal coupled to a fourth interconnect, and the third terminal coupled to the seventh interconnect; a third three-terminal display unit having a first terminal, and a second terminal, and a third terminal, the first terminal coupled to a fifth interconnect, the second terminal coupled to the fourth interconnect, and the third terminal coupled to the seventh interconnect; and a fourth three-terminal display unit having a first terminal, and a second terminal, and a third terminal, the first terminal coupled to the first interconnect, the second terminal coupled to a sixth interconnect, and the third terminal coupled to the seventh interconnect.

In some implementations, the first display unit and the fourth display unit are associated with the first group of display units, and the second display unit and the third display unit are associated with the second group of display units.

Details of one or more implementations of the subject matter described in this disclosure are set forth in the accompanying drawings and the description below. Although the examples provided in this disclosure are primarily described in terms of EMS and MEMS-based displays the concepts provided herein may apply to other types of displays such as liquid crystal displays, organic light-emitting diode ("OLED") displays, and field emission displays. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
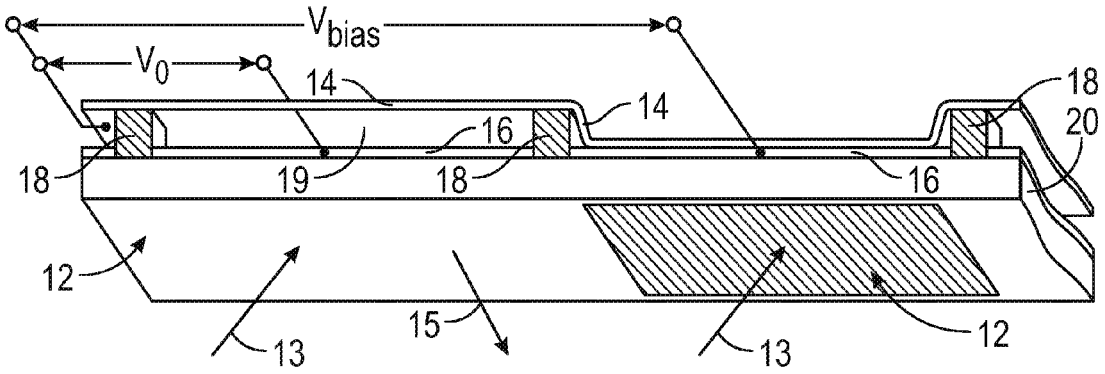
FIG. 1 is an isometric view illustration depicting two adjacent interferometric modulator (IMOD) display elements in a series or array of display elements of an IMOD display device.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (e.g., e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

Interferometric modulator (IMOD) displays can include a movable element, such as a mirror, that can be positioned at various points in order to reflect light at a specific wavelength. However, electric charge may accumulate on the various parts of the IMOD when an electric field is being applied. In an IMOD, an accumulation of charge can affect its performance. Some implementations of the subject matter described in this disclosure include reversing the polarity of the electric fields of IMODs to maintain a charge balance, and therefore, reduce the charge accumulation.

In some implementations, the IMOD may be a three-terminal device. Each terminal may be associated with an interconnect. An interconnect may "zig-zag," or alternately couple, between IMODs in different rows or columns, and therefore, provide a "checkerboard" polarity pattern for a display of IMODs. Additionally, interconnect associated with a row select may also be routed to alternately couple between switches in rows.

Particular implementations of the subject matter described in this disclosure can be implemented to realize one or more of the following potential advantages. Reversing the polarity of the electric field of IMODs can reduce the accumulation of charge that may affect performance. Additionally, a display using a three-terminal device, such as an IMOD, may utilize interconnect alternating between rows or columns to provide a dot inversion, or checkerboard, configuration that reduces visibility of flicker. Additionally, power requirements may also be reduced.

An example of a suitable EMS or MEMS device or apparatus, to which the described implementations may apply, is a reflective display device. Reflective display devices can incorporate interferometric modulator (IMOD) display elements that can be implemented to selectively absorb and/or reflect light incident thereon using principles of optical interference. IMOD display elements can include a partial optical absorber, a reflector that is movable with respect to the absorber, and an optical resonant cavity defined between the absorber and the reflector. In some implementations, the reflector can be moved to two or more different positions, which can change the size of the optical resonant cavity and thereby affect the reflectance of the IMOD. The reflectance spectra of IMOD display elements can create fairly broad spectral bands that can be shifted across the visible wavelengths to generate different colors. The position of the spectral band can be adjusted by changing the thickness of the optical resonant cavity. One way of changing the optical resonant cavity is by changing the position of the reflector with respect to the absorber.

FIG. 1 is an isometric view illustration depicting two adjacent interferometric modulator (IMOD) display elements in a series or array of display elements of an IMOD display device. The IMOD display device includes one or more interferometric EMS, such as MEMS, display elements. In these devices, the interferometric MEMS display elements can be configured in either a bright or dark state. In the bright ("relaxed," "open" or "on," etc.) state, the display element reflects a large portion of incident visible light. Conversely, in the dark ("actuated," "closed" or "off," etc.) state, the display element reflects little incident visible light. MEMS display elements can be configured to reflect predominantly at particular wavelengths of light allowing for a color display in addition to black and white. In some implementations, by using multiple display elements, different intensities of color primaries and shades of gray can be achieved.

The IMOD display device can include an array of IMOD display elements which may be arranged in rows and columns. Each display element in the array can include at least a pair of reflective and semi-reflective layers, such as a movable reflective layer (i.e., a movable layer, also referred to as a mechanical layer) and a fixed partially reflective layer (i.e., a stationary layer), positioned at a variable and controllable distance from each other to form an air gap (also referred to as an optical gap, cavity or optical resonant cavity). The movable reflective layer may be moved between at least two positions. For example, in a first position, i.e., a relaxed position, the movable reflective layer can be positioned at a distance from the fixed partially reflective layer. In a second position, i.e., an actuated position, the movable reflective layer can be positioned more closely to the partially reflective layer. Incident light that reflects from the two layers can interfere constructively and/or destructively depending on the position of the movable reflective layer and the wavelength(s) of the incident light, producing either an overall reflective or non-reflective state for each display element. In some implementations, the display element may be in a reflective state when unactuated, reflecting light within the visible spectrum, and may be in a dark state when actuated, absorbing and/or destructively interfering light within the visible range. In some other implementations, however, an IMOD display element may be in a dark state when unactuated, and in a reflective state when actuated. In some implementations, the introduction of an applied voltage can drive the display elements to change states. In some other implementations, an applied charge can drive the display elements to change states.

The depicted portion of the array in FIG. 1 includes two adjacent interferometric MEMS display elements in the form of IMOD display elements 12. In the display element 12 on the right (as illustrated), the movable reflective layer 14 is illustrated in an actuated position near, adjacent or touching the optical stack 16. The voltage $V_{bias}$ applied across the display element 12 on the right is sufficient to move and also maintain the movable reflective layer 14 in the actuated position. In the display element 12 on the left (as illustrated), a movable reflective layer 14 is illustrated in a relaxed position at a distance (which may be predetermined based on design parameters) from an optical stack 16, which includes a partially reflective layer. The voltage $V_0$ applied across the display element 12 on the left is insufficient to cause actuation of the movable reflective layer 14 to an actuated position such as that of the display element 12 on the right.

In FIG. 1, the reflective properties of IMOD display elements 12 are generally illustrated with arrows indicating light 13 incident upon the IMOD display elements 12, and light 15 reflecting from the display element 12 on the left. Most of the light 13 incident upon the display elements 12 may be transmitted through the transparent substrate 20, toward the optical stack 16. A portion of the light incident upon the optical stack 16 may be transmitted through the partially reflective layer of the optical stack 16, and a portion will be reflected back through the transparent substrate 20. The portion of light 13 that is transmitted through the optical stack 16 may be reflected from the movable reflective layer 14, back toward (and through) the transparent substrate 20. Interference (constructive and/or destructive) between the light reflected from the partially reflective layer of the optical stack 16 and the light reflected from the movable reflective layer 14 will determine in part the intensity of wavelength(s) of light 15 reflected from the display element 12 on the viewing or substrate side of the device. In some implementations, the transparent substrate 20 can be a glass substrate (sometimes referred to as a glass plate or panel). The glass substrate may be or include, for example, a borosilicate glass, a soda lime glass, quartz, Pyrex, or other suitable glass material. In some implementations, the glass substrate may have a thickness of 0.3, 0.5 or 0.7 millimeters, although in some implementations the glass substrate can be thicker (such as tens of millimeters) or thinner (such as less than 0.3 millimeters). In some implementations, a non-glass substrate can be used, such as a polycarbonate, acrylic, polyethylene terephthalate (PET) or polyether ether ketone (PEEK) substrate. In such an implementation, the non-glass substrate will likely have a thickness of less than 0.7 millimeters, although the substrate may be thicker depending on the design considerations. In some implementations, a non-transparent substrate, such as a metal foil or stainless steel-based substrate can be used. For example, a reverse-IMOD-based display, which includes a fixed reflective layer and a movable layer which is partially transmissive and partially reflective, may be configured to be viewed from the opposite side of a substrate as the display elements 12 of Figure [#A] and may be supported by a non-transparent substrate.

The optical stack 16 can include a single layer or several layers. The layer(s) can include one or more of an electrode layer, a partially reflective and partially transmissive layer, and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals (e.g., chromium and/or molybdenum), semiconductors, and dielectrics. The partially reflective layer can be formed of one or more layers of materials, and each of the layers can be formed of a single material or a combination of materials. In some implementations, certain portions of the optical stack 16 can include a single semi-transparent thickness of metal or semiconductor which serves as both a partial optical absorber and electrical conductor, while different, electrically more conductive layers or portions (e.g., of the optical stack 16 or of other structures of the display element) can serve to bus signals between IMOD display elements. The optical stack 16 also can include one or more insulating or dielectric layers covering one or more conductive layers or an electrically conductive/partially absorptive layer.

In some implementations, at least some of the layer(s) of the optical stack 16 can be patterned into parallel strips, and may form row electrodes in a display device as described further below. As will be understood by one having ordinary skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of supports, such as the illustrated posts 18, and an intervening sacrificial material located between the posts 18. When the sacrificial material is etched away, a defined gap 19, or optical cavity, can be formed between the movable reflective layer 14 and the optical stack 16. In some implementations, the spacing between posts 18 may be approximately 1-1000 μm, while the gap 19 may be approximately less than 10,000 Angstroms (Å).

In some implementations, each IMOD display element, whether in the actuated or relaxed state, can be considered as a capacitor formed by the fixed and moving reflective layers. When no voltage is applied, the movable reflective layer 14 remains in a mechanically relaxed state, as illustrated by the display element 12 on the left in Figure [#A], with the gap 19 between the movable reflective layer 14 and optical stack 16. However, when a potential difference, i.e., a voltage, is applied to at least one of a selected row and column, the capacitor formed at the intersection of the row and column electrodes at the corresponding display element becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated display element 12 on the right in FIG. 1. The behavior can be the same regardless of the polarity of the applied potential difference. Though a series of display elements in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. In some implementations, the rows may be referred to as "common" lines and the columns may be referred to as "segment" lines, or vice versa. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 2:
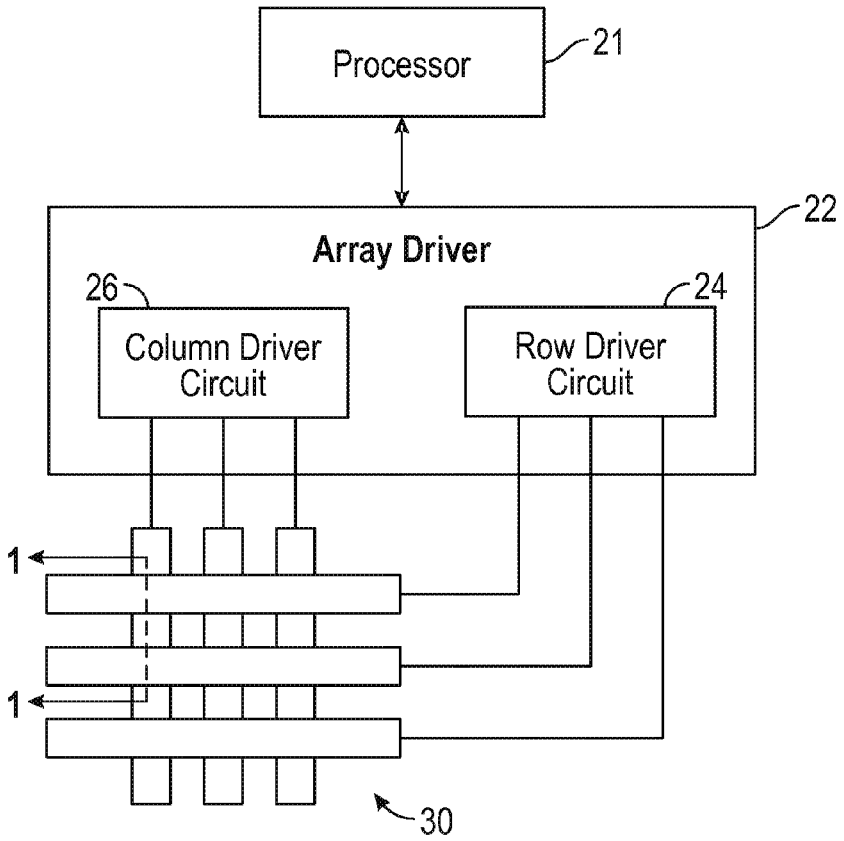
FIG. 2 is a system block diagram illustrating an electronic device incorporating an IMOD-based display including a three element by three element array of IMOD display elements.

FIG. 2 is a system block diagram illustrating an electronic device incorporating an IMOD-based display including a three element by three element array of IMOD display elements. The electronic device includes a processor 21 that may be configured to execute one or more software modules. In addition to executing an operating system, the processor 21 may be configured to execute one or more software applications, including a web browser, a telephone application, an email program, or any other software application.

The processor 21 can be configured to communicate with an array driver 22. The array driver 22 can include a row driver circuit 24 and a column driver circuit 26 that provide signals to, for example a display array or panel 30. The cross section of the IMOD display device illustrated in FIG. 1 is shown by the lines 1-1 in FIG. 2. Although FIG. 2 illustrates a 3×3 array of IMOD display elements for the sake of clarity, the display array 30 may contain a very large number of IMOD display elements, and may have a different number of IMOD display elements in rows than in columns, and vice versa.

Figure 3A:
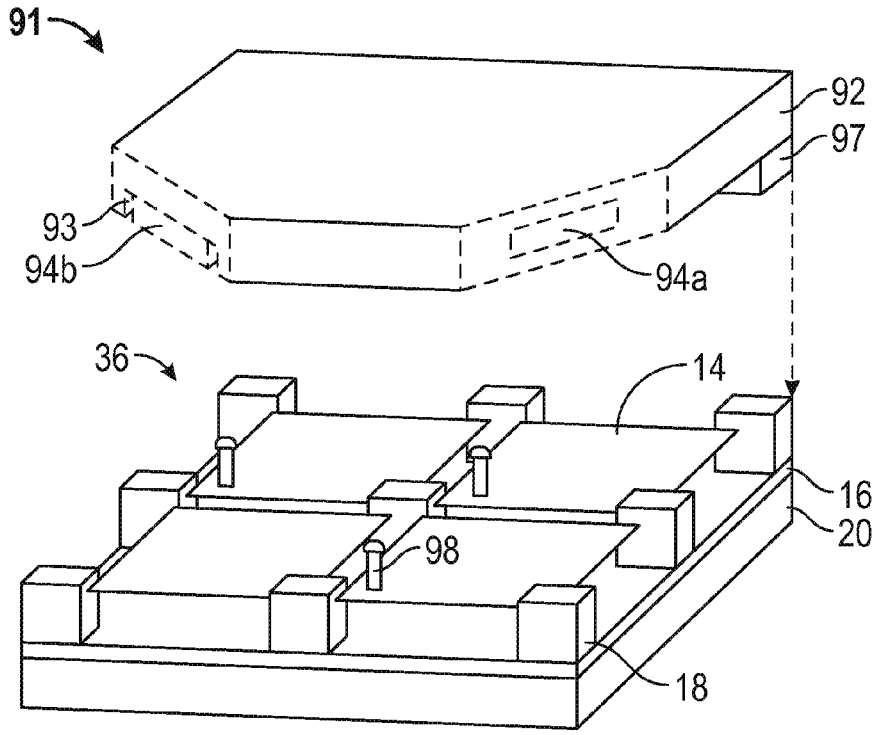
FIGS. 3A and 3B are schematic exploded partial perspective views of a portion of an electromechanical systems (EMS) package including an array of EMS elements and a backplate.
Figure 3B:
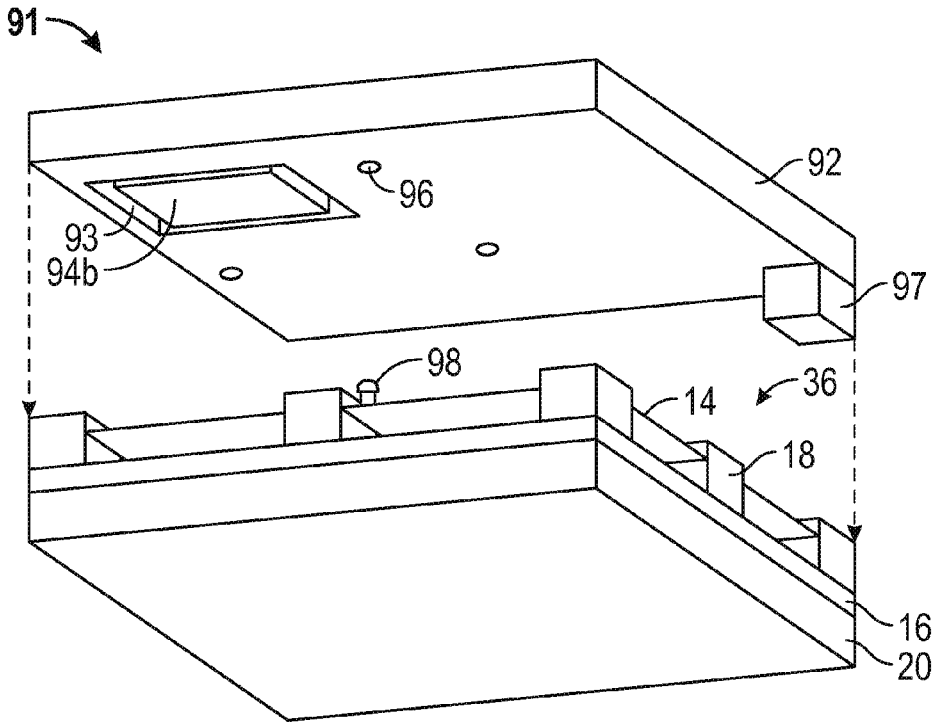

FIGS. 3A and 3B are schematic exploded partial perspective views of a portion of an EMS package 91 including an array 36 of EMS elements and a backplate 92. FIG. 3A is shown with two corners of the backplate 92 cut away to better illustrate certain portions of the backplate 92, while FIG. 3B is shown without the corners cut away. The EMS array 36 can include a substrate 20, support posts 18, and a movable layer 14. In some implementations, the EMS array 36 can include an array of IMOD display elements with one or more optical stack portions 16 on a transparent substrate, and the movable layer 14 can be implemented as a movable reflective layer.

The backplate 92 can be essentially planar or can have at least one contoured surface (e.g., the backplate 92 can be formed with recesses and/or protrusions). The backplate 92 may be made of any suitable material, whether transparent or opaque, conductive or insulating. Suitable materials for the backplate 92 include, but are not limited to, glass, plastic, ceramics, polymers, laminates, metals, metal foils, Kovar and plated Kovar.

As shown in FIGS. 3A and 3B, the backplate 92 can include one or more backplate components 94*a* and 94*b*, which can be partially or wholly embedded in the backplate 92. As can be seen in FIG. 3A, backplate component 94*a* is embedded in the backplate 92. As can be seen in FIGS. 3A and 3B, backplate component 94*b* is disposed within a recess 93 formed in a surface of the backplate 92. In some implementations, the backplate components 94*a* and/or 94*b* can protrude from a surface of the backplate 92. Although backplate component 94*b* is disposed on the side of the backplate 92 facing the substrate 20, in other implementations, the backplate components can be disposed on the opposite side of the backplate 92.

The backplate components 94*a* and/or 94*b* can include one or more active or passive electrical components, such as transistors, capacitors, inductors, resistors, diodes, switches, and/or integrated circuits (ICs) such as a packaged, standard or discrete IC. Other examples of backplate components that can be used in various implementations include antennas, batteries, and sensors such as electrical, touch, optical, or chemical sensors, or thin-film deposited devices.

In some implementations, the backplate components 94*a* and/or 94*b* can be in electrical communication with portions of the EMS array 36. Conductive structures such as traces, bumps, posts, or vias may be formed on one or both of the backplate 92 or the substrate 20 and may contact one another or other conductive components to form electrical connections between the EMS array 36 and the backplate components 94*a* and/or 94*b*. For example, FIG. 3B includes one or more conductive vias 96 on the backplate 92 which can be aligned with electrical contacts 98 extending upward from the movable layers 14 within the EMS array 36. In some implementations, the backplate 92 also can include one or more insulating layers that electrically insulate the backplate components 94*a* and/or 94*b* from other components of the EMS array 36. In some implementations in which the backplate 92 is formed from vapor-permeable materials, an interior surface of backplate 92 can be coated with a vapor barrier (not shown).

The backplate components 94*a* and 94*b* can include one or more desiccants which act to absorb any moisture that may enter the EMS package 91. In some implementations, a desiccant (or other moisture absorbing materials, such as a getter) may be provided separately from any other backplate components, for example as a sheet that is mounted to the backplate 92 (or in a recess formed therein) with adhesive. Alternatively, the desiccant may be integrated into the backplate 92. In some other implementations, the desiccant may be applied directly or indirectly over other backplate components, for example by spray-coating, screen printing, or any other suitable method.

In some implementations, the EMS array 36 and/or the backplate 92 can include mechanical standoffs 97 to maintain a distance between the backplate components and the display elements and thereby prevent mechanical interference between those components. In the implementation illustrated in FIGS. 3A and 3B, the mechanical standoffs 97 are formed as posts protruding from the backplate 92 in alignment with the support posts 18 of the EMS array 36. Alternatively or in addition, mechanical standoffs, such as rails or posts, can be provided along the edges of the EMS package 91.

Although not illustrated in FIGS. 3A and 3B, a seal can be provided which partially or completely encircles the EMS array 36. Together with the backplate 92 and the substrate 20, the seal can form a protective cavity enclosing the EMS array 36. The seal may be a semi-hermetic seal, such as a conventional epoxy-based adhesive. In some other implementations, the seal may be a hermetic seal, such as a thin film metal weld or a glass frit. In some other implementations, the seal may include polyisobutylene (PIB), polyurethane, liquid spin-on glass, solder, polymers, plastics, or other materials. In some implementations, a reinforced sealant can be used to form mechanical standoffs.

In alternate implementations, a seal ring may include an extension of either one or both of the backplate 92 or the substrate 20. For example, the seal ring may include a mechanical extension (not shown) of the backplate 92. In some implementations, the seal ring may include a separate member, such as an O-ring or other annular member.

In some implementations, the EMS array 36 and the backplate 92 are separately formed before being attached or coupled together. For example, the edge of the substrate 20 can be attached and sealed to the edge of the backplate 92 as discussed above. Alternatively, the EMS array 36 and the backplate 92 can be formed and joined together as the EMS package 91. In some other implementations, the EMS package 91 can be fabricated in any other suitable manner, such as by forming components of the backplate 92 over the EMS array 36 by deposition.

Figure 4:
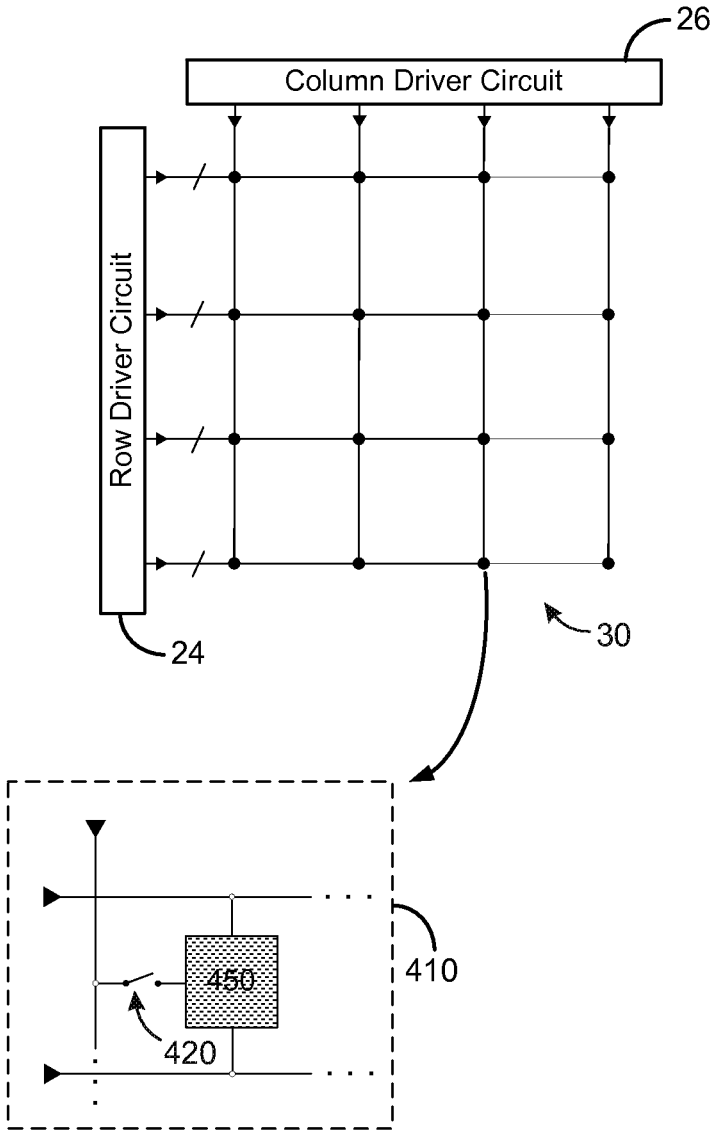
FIG. 4 is an example of a system block diagram illustrating an electronic device incorporating an IMOD-based display.

FIG. 4 is an example of a system block diagram illustrating an electronic device incorporating an IMOD-based display. Moreover, FIG. 4 depicts an implementation of row driver circuit 24 and column driver circuit 26 of array driver 22 that provide signals to, for example, display array or panel 30, as previously discussed.

As an example, display module 410 in the fourth row may include switch 420 and display unit 450. Display module 410 may be provided a row signal and a common signal from row driver circuit 24. Display module 410 may also be provided a column signal from column driver circuit 26. The implementation of display module 410 may include a variety of different designs. In some implementations, display unit 450 may be coupled with switch 420, such as a transistor with its gate coupled to the row signal and the column signal provided to the drain. Each display unit 450 may include an IMOD display element. In some implementations, each display unit 450 corresponds to a pixel in the display panel 30.

Figure 5:
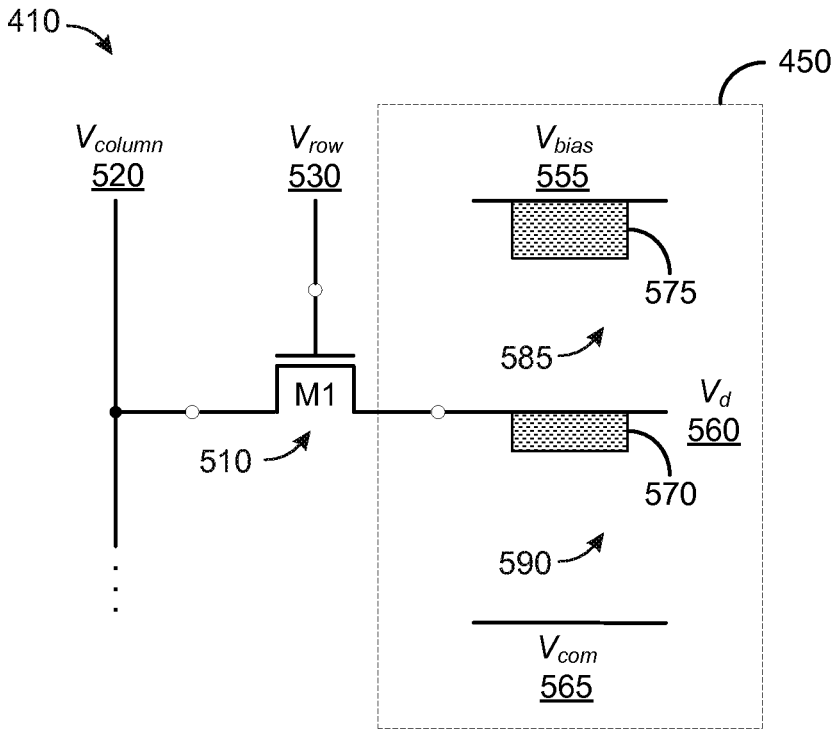
FIG. 5 is a circuit schematic of an example of a three terminal IMOD.

FIG. 5 is a circuit schematic of an example of a three terminal IMOD. In some implementations, the circuit of FIG. 5 may include display unit 450 (e.g., an IMOD) of FIG. 4. The circuit of FIG. 5 includes switch 420 of FIG. 4 implemented as an n-type metal oxide semiconductor (NMOS) transistor M1 510. The gate of transistor M1 510 is coupled to $V_{row}$ 530, which may be provided by row driver circuit 24 of FIG. 4. Transistor M1 510 is also coupled to $V_{column}$ 520, which may be provided by column driver circuit 26 of FIG. 4. In particular, if $V_{row}$ 530 is biased to turn transistor M1 510 on, the voltage on $V_{column}$ 520 may be applied to $V_d$ electrode 560.

In an implementation, display unit 450 may be a three terminal IMOD including three terminals or electrodes: $V_{bias}$ electrode 555, $V_d$ electrode 560, and $V_{com}$ electrode 565. Display unit 450 may also include movable element 570 and dielectric 575. Movable element 570 may include a mirror. Movable element 570 may be coupled with $V_d$ electrode 560. Additionally, in some implementations, air gap 585 may be between $V_{bias}$ electrode 555 and $V_d$ electrode 560. Air gap 590 may be between $V_d$ electrode 560 and $V_{com}$ electrode 565. In some implementations, display unit 450 may also include one or more capacitors. For example, one or more capacitors may be coupled between $V_d$ electrode 560 and $V_{com}$ electrode 565 or between $V_{bias}$ electrode 555 and $V_d$ electrode 560.

Movable element 570 may be positioned at various points between $V_{bias}$ electrode 555 and $V_{com}$ electrode 565 in order to reflect light at a specific wavelength. In particular, applied voltage biases of $V_{bias}$ electrode 555, $V_d$ electrode 560, and $V_{com}$ electrode 565 may determine the position of movable element 570.

The voltage biases of $V_{bias}$ electrode 555, $V_d$ electrode 560, and $V_{com}$ electrode 565 may also create electric fields within display unit 450. FIGS. 6A, 6B, 6C, and 6D are illustrations of electric fields in the circuit schematic of FIG. 5. In particular, in FIG. 6A, if a voltage applied to $V_{bias}$ electrode 555 is higher than a voltage applied to $V_d$ electrode 560, and the voltage applied to $V_d$ electrode 560 is higher than a voltage applied to $V_{com}$ electrode 565, then electric field 605 with a direction pointing from $V_{bias}$ electrode 555 to $V_d$ electrode 560 (i.e., from high potential to low potential) may be created. Additionally, electric field 610 with a direction pointing from $V_d$ electrode 560 to $V_{com}$ electrode 565 may also be created. As an example, electric fields 605 and 610 may both point downward in FIG. 6A if, for example, $V_{bias}$ electrode 555 is biased at 10 V (Volts), $V_d$ electrode 560 is biased at 5 V, and $V_{com}$ electrode 565 is biased at 0 V.

Figure 6A:
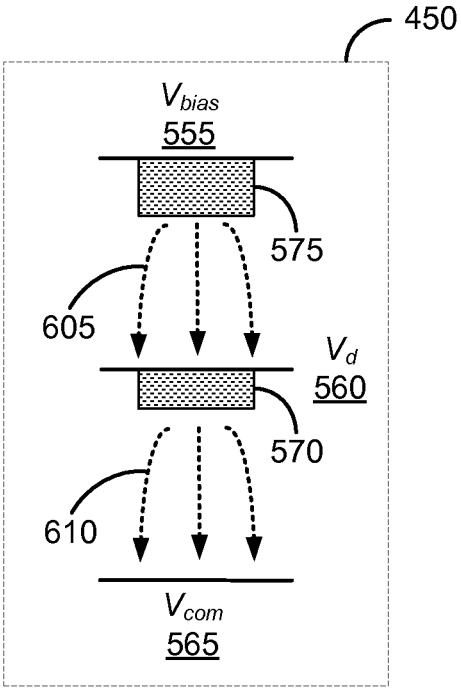
FIGS. 6A, 6B, 6C, and 6D are illustrations of electric fields in the circuit schematic of FIG. 5.
Figure 6B:
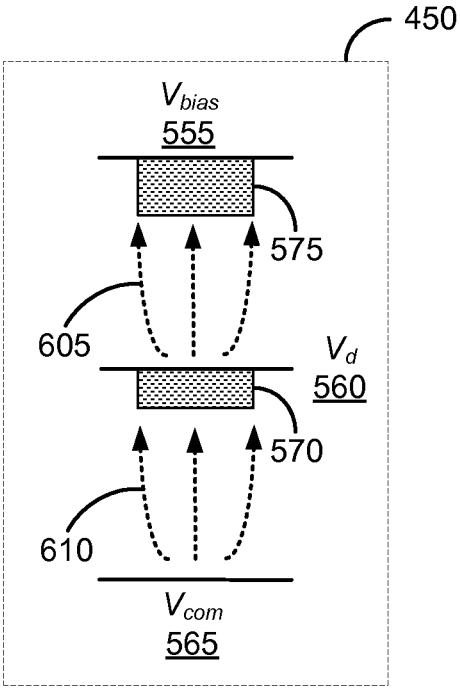

In FIG. 6B, electric fields 605 and 610 are in an opposite direction than in FIG. 6A. In particular, if a voltage applied to $V_{bias}$ electrode 555 is lower than a voltage applied to $V_d$ electrode 560, and the voltage applied to $V_d$ electrode 560 is lower than a voltage applied to $V_{com}$ electrode 565, then electric field 605 may point from $V_d$ electrode 560 to $V_{bias}$ electrode 555. Additionally, electric field 610 may point from $V_{com}$ electrode 565 to $V_d$ electrode 560. As an example, electric fields 605 and 610 may both point upward in FIG. 6B if, for example, $V_{bias}$ electrode 555 is biased at 0 V, $V_d$ electrode 560 is biased at 5 V, and $V_{com}$ electrode 565 is biased at 10 V.

Accordingly, switching the polarity between electrodes may switch the directions of electric fields 605 and 610 in display unit 450 (e.g., a three terminal IMOD). That is, voltages applied to $V_{bias}$ electrode 555, $V_d$ electrode 560, and/or $V_{com}$ electrode 565 may be changed such that electric fields 605 and 610 may switch direction.

Figure 6C:
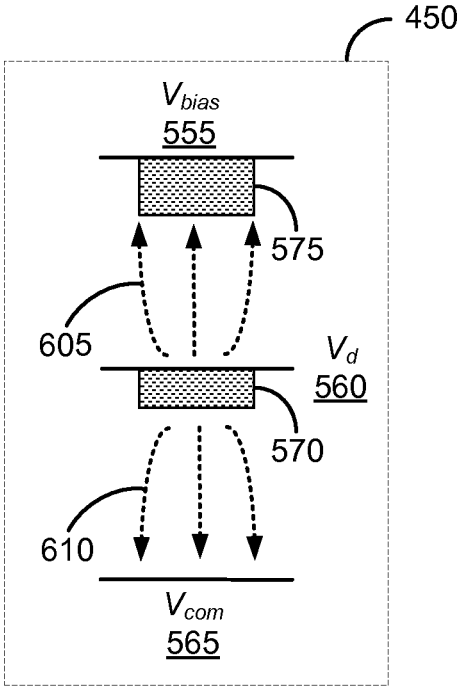
Figure 6D:
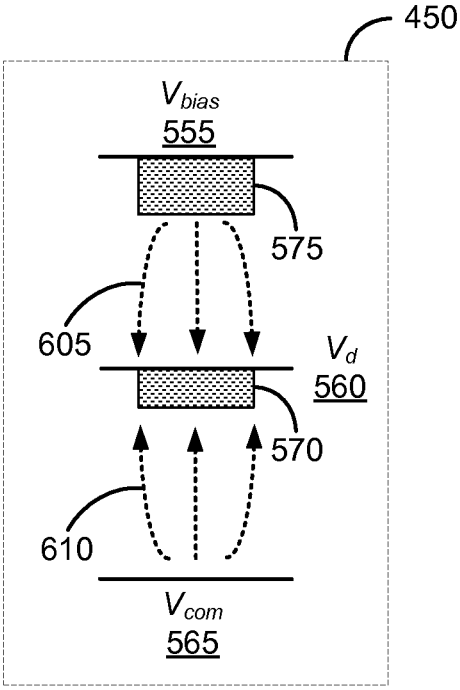

FIGS. 6C and 6D also illustrate electric fields induced within display unit 450, such as a three terminal IMOD. In particular, in FIG. 6C, if a voltage applied to $V_{bias}$ electrode 555 is lower than a voltage applied to $V_d$ electrode 560, and the voltage applied to $V_d$ electrode 560 is higher than a voltage applied to $V_{com}$ electrode 565, then electric field 605 with a direction pointing from $V_d$ electrode 560 to $V_{bias}$ electrode 555 may be generated. Additionally, electric field 610 with a direction pointing from $V_d$ electrode 560 to $V_{com}$ electrode 565 may also be created. That is, electric fields 605 and 610 may point in opposite directions away from $V_d$ electrode 560. As an example, electric fields 605 and 610 may both point in opposite directions in FIG. 6C if, for example, $V_{bias}$ electrode 555 is biased at 10 5 (Volts), $V_d$ electrode 560 is biased at 10 V, and $V_{com}$ electrode 565 is biased at 0 V.

In FIG. 6D, electric fields 605 and 610 are in an opposite direction than in FIG. 6C. That is, both electric fields 605 and 610 both point towards $V_d$ electrode 560. In particular, if a voltage applied to $V_{bias}$ electrode 555 is higher than a voltage applied to $V_d$ electrode 560, and the voltage applied to $V_d$ electrode 560 is lower than a voltage applied to $V_{com}$ electrode 565, then electric field 605 may point from $V_{bias}$ electrode 555 to $V_d$ electrode 560. Additionally, electric field 610 may point from $V_{com}$ electrode 565 to $V_d$ electrode 560. As an example, electric fields 605 and 610 may both point towards $V_d$ electrode 560 in FIG. 6D if, for example, $V_{bias}$ electrode 555 is biased at 10 V, $V_d$ electrode 560 is biased at 0 V, and $V_{com}$ electrode 565 is biased at 5 V.

In the aforementioned examples, the voltages range from 0 to 10 V. However, any other voltage values to invert polarity between electrodes, and therefore change the directions of electric fields, may be used. For example, a range of 0 to −10 V may be used. Additionally, a fixed voltage may be applied to one of $V_{bias}$ electrode 555 or $V_{com}$ electrode 565 and the voltage applied to the other electrode may switch. For example, $V_{com}$ electrode 565 may be fixed at 0 V. To invert the polarity between $V_{com}$ electrode 565 and $V_{bias}$ electrode 555, $V_{bias}$ electrode 555 may swing between 10 V and −10 V. As another example, $V_{com}$ electrode may be fixed at 10 V and $V_{bias}$ electrode 555 may swing between 15 V and 5 V. As another example, $V_{com}$ electrode may be fixed at −10 V and $V_{bias}$ electrode 555 may swing between −15 V and −5 V. In another implementation, $V_{bias}$ electrode 555 may be fixed and $V_{com}$ electrode 565 may switch in voltage. In another implementation, one electrode, such as $V_{com}$ electrode 565 may be fixed to a voltage and both $V_{bias}$ electrode 555 and $V_d$ electrode 560 may change in voltages.

In another example, $V_{com}$ electrode 565 may be fixed, for example, at 0 V. $V_{bias}$ electrode 555 may be 5 V and $V_d$ electrode 560 may be at 10 V. Accordingly, to switch polarity, $V_{bias}$ electrode 555 may be switched to 10 V and $V_d$ electrode 560 may be switched to 5 V. In another example, $V_{bias}$ electrode 555 may be switched to −5 V and $V_d$ electrode 560 may be switched to −10 V.

Electric charge may accumulate throughout a device when an electric field is applied. Periodically switching the direction of electric fields within a device may substantially maintain charge balance in the device, and therefore, reduce charge accumulation. In an IMOD, an accumulation of electric charge can affect its performance. Switching the direction of the electric fields induced in the device may reduce the effects of charge accumulation, and thus reduce or mitigate the effect on performance of the IMOD. As such, switching the direction of the electric fields 605 and 610 as in FIGS. 6A and 6B, FIGS. 6C and 6D, or in the other examples disclosed herein can reduce the accumulation of charge that may affect the performance of the IMOD.

Figure 7A:
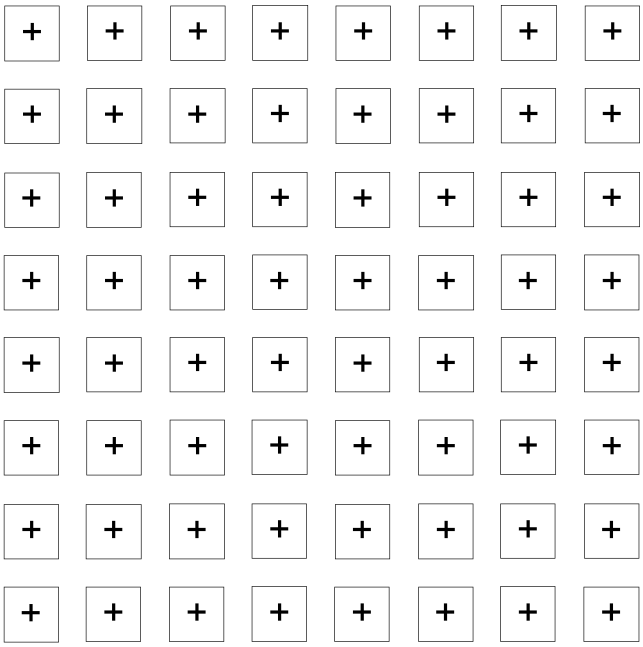
FIGS. 7A and 7B are illustrations of examples of polarities for an IMOD-based display.
Figure 7B:
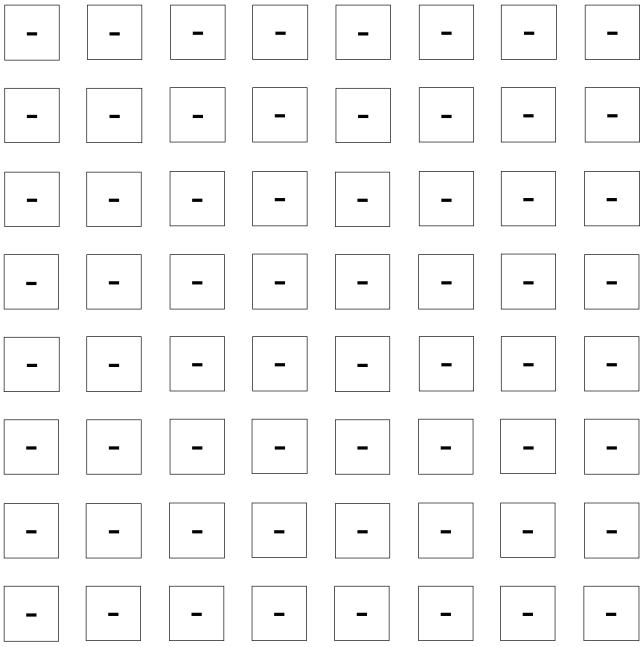

FIGS. 7A and 7B are illustrations of examples of polarities for an IMOD-based display. In FIG. 7A, during a first frame (e.g., even frames), the polarity may be positive (e.g., associated with FIG. 6A). Accordingly, each IMOD in the IMOD-based display may have a positive polarity. In FIG. 7B, during a second frame (e.g., odd frames), the polarities between electrodes may be reversed, and therefore, be negative (e.g., associated with FIG. 6B).

However, switching polarities can cause a visible flicker on displays due to differences between performances of display units (e.g., IMODs) in positive and negative polarities. For example, switching the direction of electric fields 605 and 610 may slightly pull movable element 570 towards an electrode, and therefore, cause its mirror to reflect light at another wavelength, creating flicker between frames.

Figure 8:
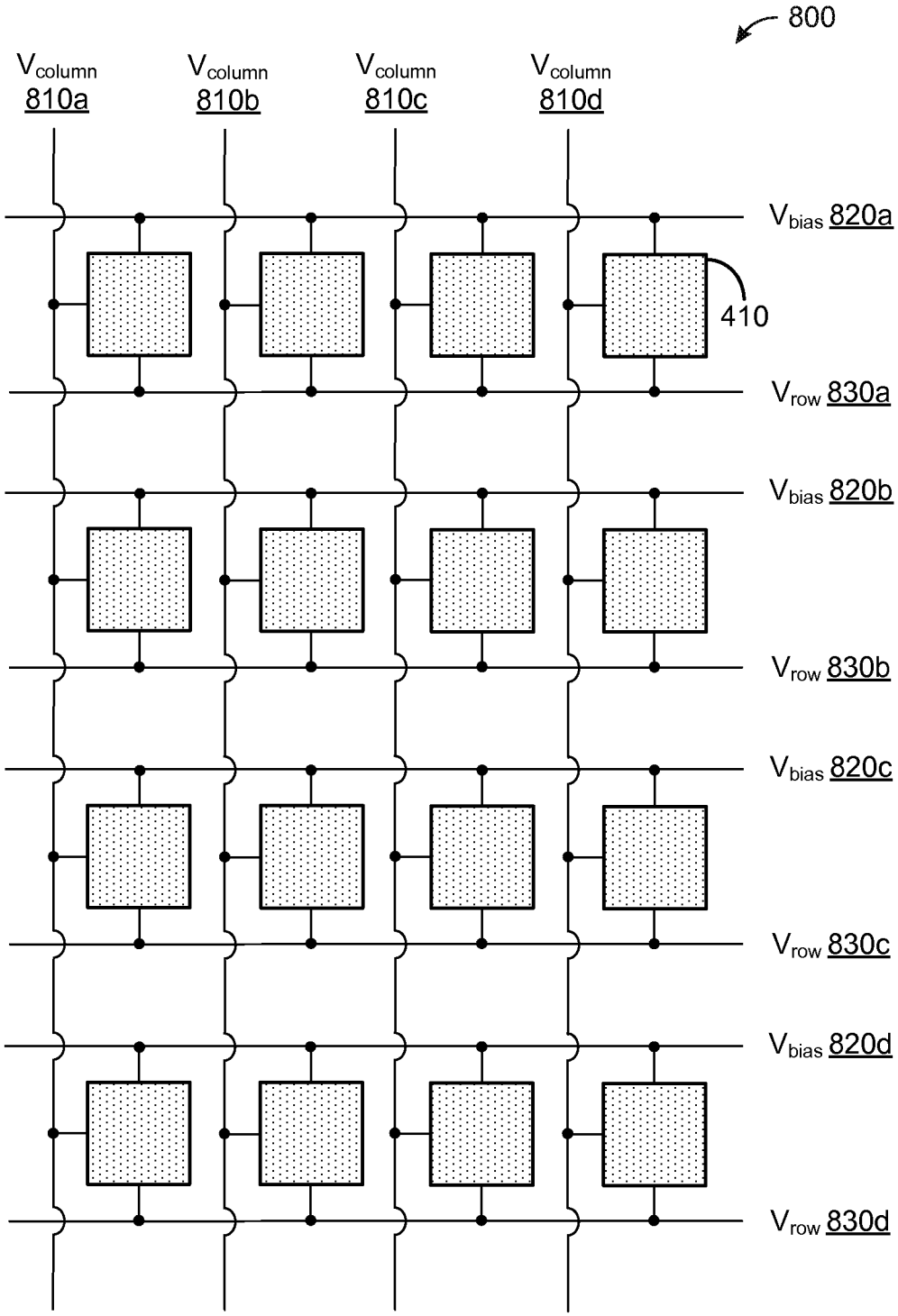
FIG. 8 is a circuit schematic of an example of an IMOD-based display using line inversion.

The polarities of the pixels may be arranged in particular patterns to reduce the visibility of flicker. FIG. 8 is a circuit schematic of an example of an IMOD-based display using line inversion. Line inversion may provide less visible flicker than the arrangement of FIGS. 7A and 7B.

Figure 9:
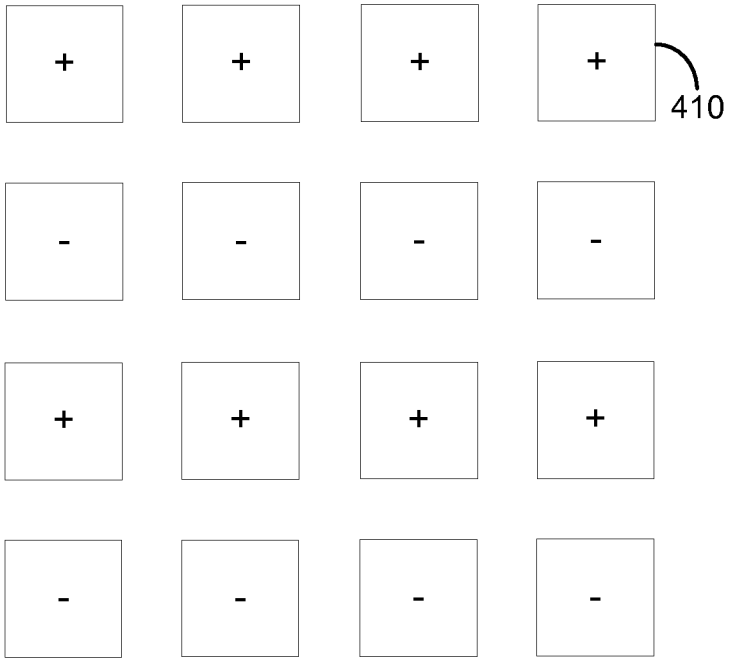
FIG. 9 is an illustration of an example of polarities provided by the circuit schematic of FIG. 8.

In FIG. 8, an array 800 of display modules 410 includes an arrangement of interconnect to create a line inversion pattern of polarities. For example, FIG. 9 is an illustration of an example of polarities provided by the circuit schematic of FIG. 8. The circuit of FIG. 8 portrays interconnect $V_{bias}$ 820*a*-820*d*, $V_{column}$ 810*a*-810*d*, and $V_{row}$ 830*a*-830*d* associated with $V_{bias}$ electrode 555, $V_{column}$ 520, and $V_{row}$ 530, respectively. As previously discussed with respect to FIG. 5, if $V_{row}$ 530 is biased at a voltage to turn on transistor M1 510 on, the voltage provided by $V_{column}$ 520 may be applied to $V_d$ electrode 560 of an IMOD.

In particular, each of $V_{column}$ 810*a*-810*d* is coupled to display modules in a column. For example, $V_{column}$ 810*a* is coupled to the four display modules in the first column. Likewise, $V_{column}$ 810*b*, $V_{column}$ 810*c*, and $V_{column}$ 810*d* are also coupled with the display modules in the respective columns.

Each of $V_{bias}$ 820*a*-820*d* and $V_{row}$ 830*a*-830*d* are coupled to display modules in a row. For example, $V_{bias}$ 820*a* is coupled to each display modules in the first row. $V_{bias}$ 820*b* is coupled to each display modules in the second row. Each of $V_{row}$ 830*a*-830*d* is also coupled to display modules in single rows.

As previously discussed, a three terminal IMOD, such as display unit 450 in FIG. 5, includes three terminals: $V_{bias}$ electrode 555, $V_d$ electrode 560, and $V_{com}$ electrode 565. When $V_{row}$ 530 turns on transistor M1 510, the voltage on $V_{column}$ 520 is applied to $V_d$ electrode 560. Additionally, though routing associated with $V_{com}$ electrode 565 is not shown in FIG. 8, $V_{com}$ electrode 565 for each display unit 450 in the display array may be driven to a fixed voltage (e.g., 0 V). However, in other implementations, interconnect providing a voltage bias for $V_{com}$ electrode 565 may be routed similar to that of $V_{bias}$ 820*a*-820*d*.

FIG. 9 is an illustration of an example of polarities provided by the circuit schematic of FIG. 8. In FIG. 9, the polarities of each row alternate. For example, in a first frame, odd numbered rows (e.g., the first row, the third row, etc.) may be associated with a positive polarity. In the same frame, even numbered rows (e.g., the second row, the fourth row, etc.) may be associated with a negative polarity. In the next frame, the polarities of the rows may switch. That is, the polarity of the odd numbered rows may switch from positive to negative. The polarity of the even numbered rows may switch from negative to positive.

The circuit of FIG. 8 may provide the polarity pattern or arrangement of FIG. 9 by inverting the polarity of each display unit 410 row-by-row by switching the directions of electric fields as discussed with respect to FIGS. 6A-6D and other techniques described herein. For example, a voltage may be applied to $V_{bias}$ 820*a*. Likewise, voltages may be applied to $V_{column}$ 810*a*-820*d*. $V_{row}$ 830*a* may apply a voltage to transistors M1 510 to "write," or apply, the voltage on $V_{column}$ 810*a*-810*d* to the respective display modules 410 in the first row. Accordingly, the display modules 410 may in the first row may be set, for example, a positive polarity. Next, the voltages for the interconnects for the second row may be updated to a negative polarity. Each row may be set, or updated, one at a time to a particular polarity to provide the pattern of FIG. 9.

However, in the circuit of FIG. 8, $V_{column}$ 810*a*-810*d* alternate in voltages providing positive and negative polarities from row-to-row for each row of display modules 410. For example, $V_{column}$ 810*a* may need to be biased to provide a first polarity (e.g., a positive polarity) to the first display module 410 in the first row. When the second row is being updated, $V_{column}$ 810*a* may need to be biased to provide a second polarity (e.g., a negative polarity) to the first display module 410 in the second row. Alternating $V_{column}$ 810*a*-810*d* as each row is updated to a particular polarity may increase power requirements. Additionally, flicker may still be relatively visible in a line inversion configuration.

Figure 10:
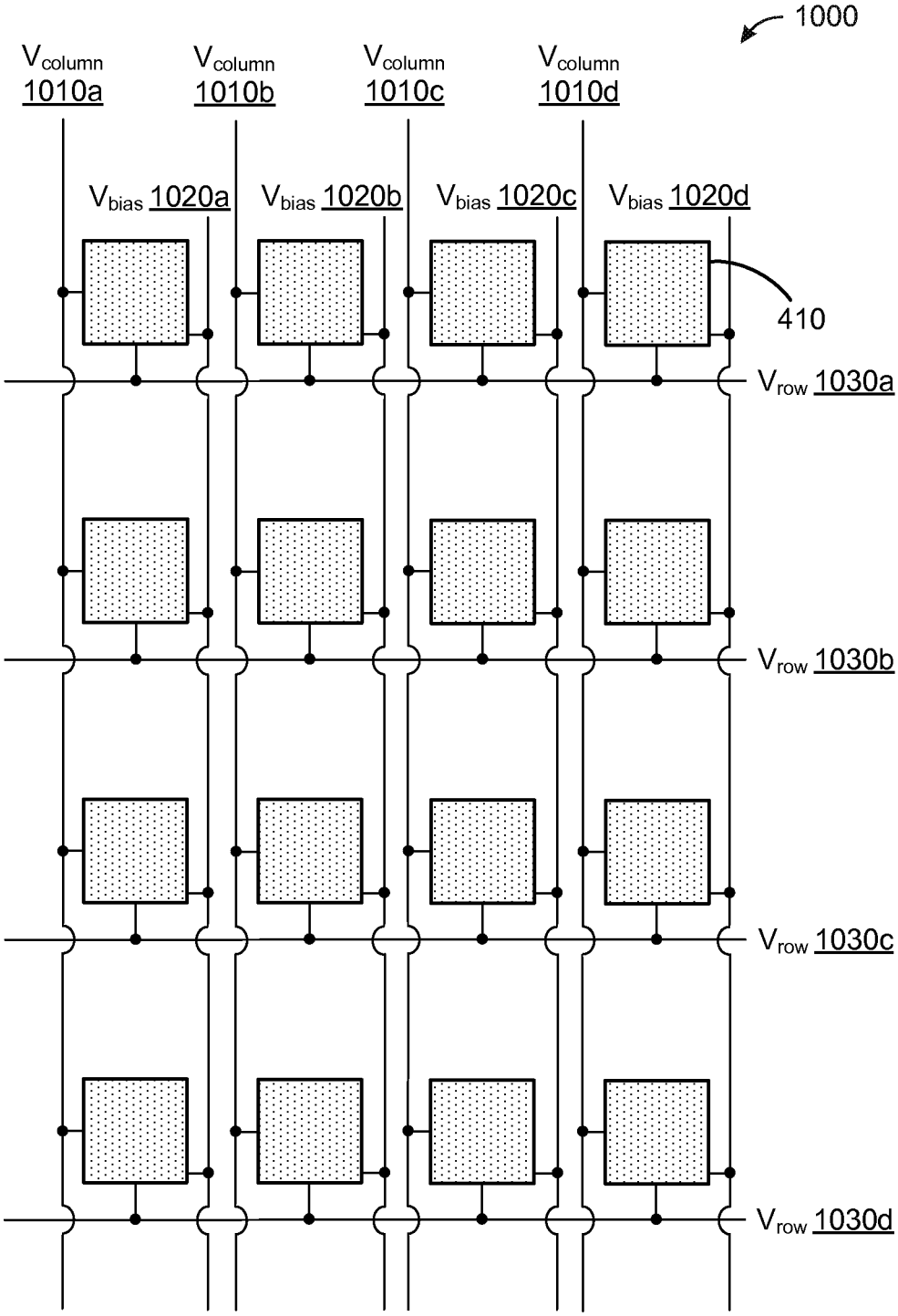
FIG. 10 is a circuit schematic of an example of an IMOD-based display using column inversion.
Figure 11:
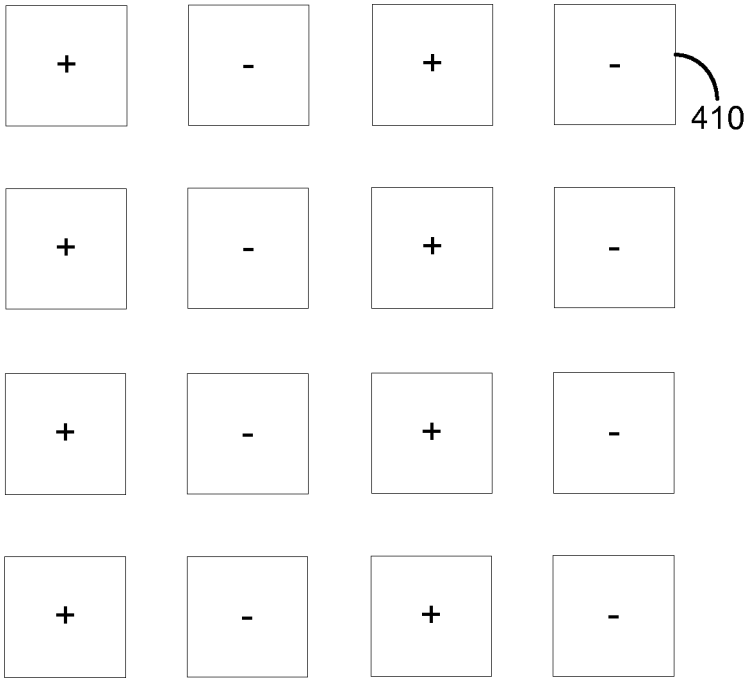
FIG. 11 is an illustration of an example of polarities provided by the circuit schematic of FIG. 10.

FIG. 10 is a circuit schematic of an example of an IMOD-based display using column inversion. FIG. 11 is an illustration of an example of polarities provided by the circuit schematic of FIG. 10. Column line inversion may also produce less perceived flicker than the arrangements of FIGS. 7A and 7B.

In FIG. 10, an array 1000 of display modules 410 includes an arrangement of interconnect to create a column inversion pattern of polarities. In particular, each of $V_{column}$ 1010*a*-1010*d* and $V_{bias}$ 1020*a*-1020*d* are routed vertically between columns of display modules 410. That is, $V_{bias}$ 1020*a*-1020*d* are routed vertically between columns rather than in rows as in the circuit schematic of FIG. 8. Additionally, each of $V_{column}$ 1010*a*-1010*d* and $V_{bias}$ 1020*a*-1020*d* couple to display modules 410 in a column. For example, $V_{column}$ 1010*a* and $V_{bias}$ 1020*a* couple to each display module 410 in the first column. Additionally, each of $V_{row}$ 1030*a*-1030*d* is also coupled to each display module 410 in a row, as in the configuration of FIG. 8. As previously discussed with FIG. 8, interconnect associated with $V_{com}$ electrode 565 may also be provided, and in some implementations, driven to a fixed voltage.

FIG. 11 is an illustration of an example of polarities provided by the circuit schematic of FIG. 10. In FIG. 11, the polarities of each column alternate. For example, in a first frame, odd numbered columns (e.g., the first column, the third column, etc.) may be associated with a positive polarity. In the same frame, even numbered columns (e.g., the second column, the fourth column, etc.) may be associated with a negative polarity. In the next frame, the polarities of the columns may switch. That is, the polarity of the odd numbered columns may switch from positive to negative. The polarity of the even numbered columns may switch from negative to positive.

In particular, the circuit of FIG. 10 may provide the polarity pattern or arrangement of FIG. 11 by inverting the polarity of each display module 410 row-by-row. For example, the voltage biases of $V_{column}$ 1010*a* and $V_{bias}$ 1020*a* may be provided to generate a positive polarity to the first display module 410 in the first row when a voltage is asserted on $V_{row}$ 1030*a* that allows $V_{column}$ 1010*a* to be applied to an electrode of the IMOD. $V_{column}$ 1010*b* and $V_{bias}$ 1020*b* may provide a negative polarity to the second display module 410 in the first row. $V_{column}$ 1010*c* and $V_{bias}$ 1020*c* may apply voltages that provide a positive polarity to the third display module 410 in the first row, and $V_{column}$ 1010*d* and $V_{bias}$ 1020*d* may apply voltages that provide a negative polarity to the fourth display module 410 in the first row. The subsequent $V_{row}$ 1030*b*-1030*d* may also be asserted row-by-row to apply the polarities.

Unlike the circuit of FIG. 8, where $V_{column}$ 710*a*-710*d* may change from providing positive and negative polarities between each row, $V_{column}$ 1010*a*-1010*d* in FIG. 10 provide the same polarity for each display module it is coupled with (i.e., the display modules in the same column), and therefore, reduce power requirements. However, for a three-terminal IMOD array using column inversion, additional complexity is added because the $V_{bias}$ electrode 555 and $V_d$ electrode 560 may need to be disconnected until the IMOD is ready to be updated. In particular, the bias lines need to be disconnected to prevent the pixels from changing state when the bias lines are switched because the bias lines are updated once per frame, but the pixels are updated row-by-row. Additionally, flicker can still be relatively visible.

Figure 12:
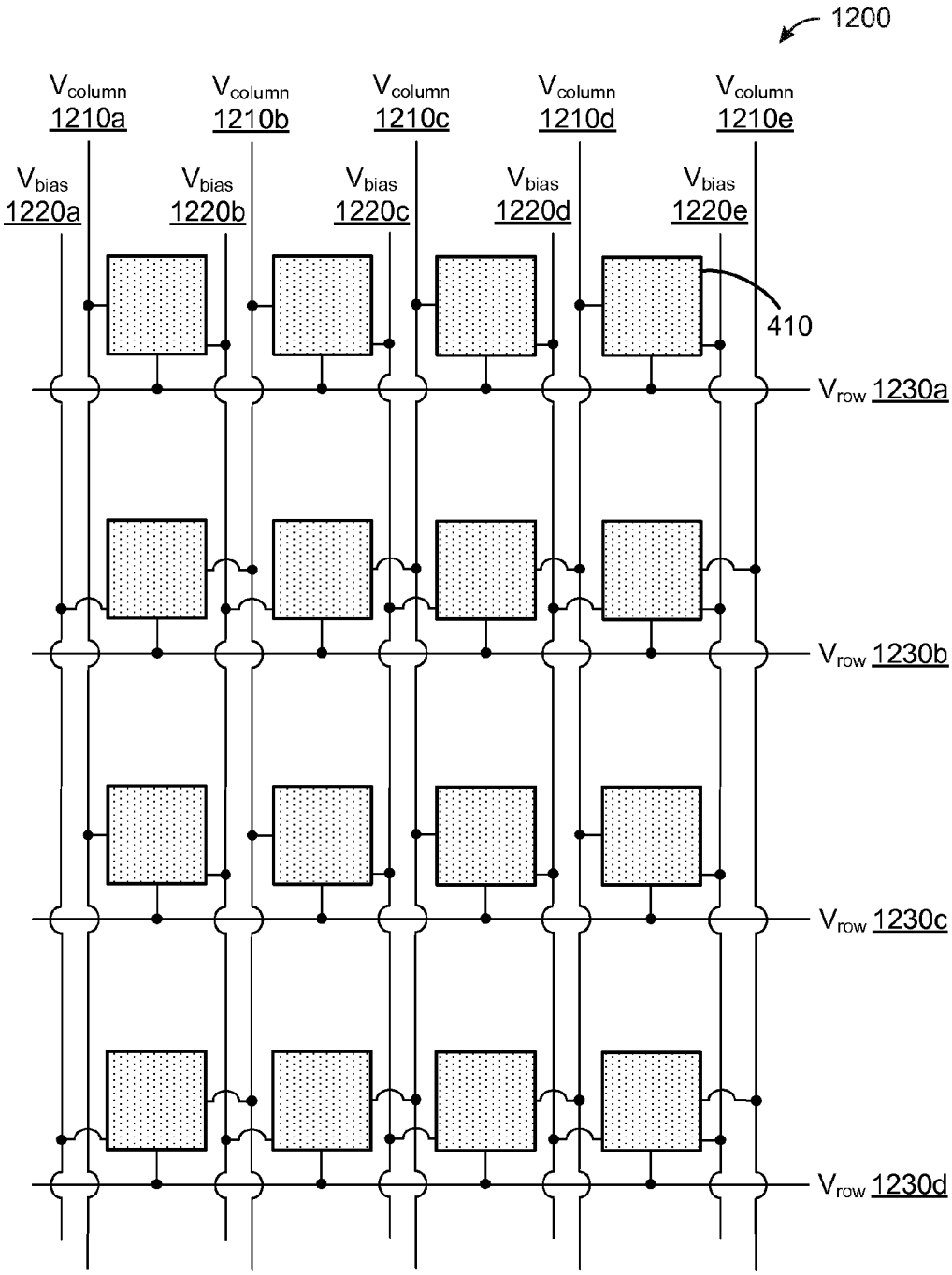
FIG. 12 is a circuit schematic of an example of an IMOD-based display using dot inversion.
Figure 13:
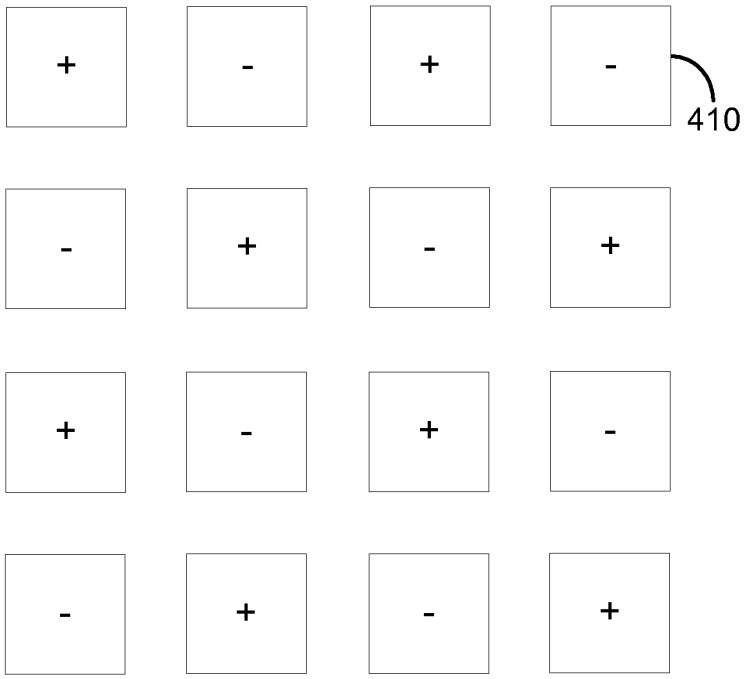
FIG. 13 is an illustration of an example of polarities provided by the circuit schematic of FIG. 12.

FIG. 12 is a circuit schematic of an example of an IMOD-based display using dot inversion. FIG. 13 is an illustration of an example of polarities provided by the circuit schematic of FIG. 12. Dot inversion may produce less perceived flicker than the arrangements of FIGS. 7A and 7B, FIG. 9, and FIG. 11.

In FIG. 12, an array 1200 of display modules 410 includes an arrangement of interconnect to create a dot inversion, or "checkerboard," pattern of polarities. In particular, each of $V_{column}$ 1210*a*-1210*e* and $V_{bias}$ 1220*a*-1220*b* are routed vertically between columns of display modules 410. Each of $V_{column}$ 1210*a*-1210*e* and $V_{bias}$ 1220*a*-1220*e* alternately couple to display modules 410 in different columns. For example, $V_{column}$ 1210*a* is coupled to the first and third display modules in the first column. $V_{column}$ 1210*b* is coupled to the first and third display modules in the second column and the second and fourth display modules in the first column. That is, $V_{column}$ 1210*b* alternately couples, or "zig-zags," between display modules in two different columns, but is only coupled to a single display module in a row. $V_{bias}$ 1220*a*-1210*e* are also coupled to display modules in a similar pattern. For example, $V_{bias}$ 1220*b* is coupled to the first and third display modules in the first column and the second and fourth display modules in the second column.

As an example, for the first row, $V_{column}$ 1210*a*, $V_{column}$ 1210*c*, $V_{bias}$ 1220*b*, and $V_{bias}$ 1220*d* may be biased to provide a positive polarity for the first and third display module 410. $V_{column}$ 1210*b*, $V_{column}$ 1210*d*, $V_{bias}$ 1220*c*, and $V_{bias}$ 1220*e* may be biased to provide a negative polarity for the second and fourth display modules 410.

However, as in column inversion of FIG. 10 and FIG. 11, the $V_{bias}$ electrode 555 and $V_d$ electrode 560 may also need to be disconnected until the respective row is selected for updating.

Figure 14:
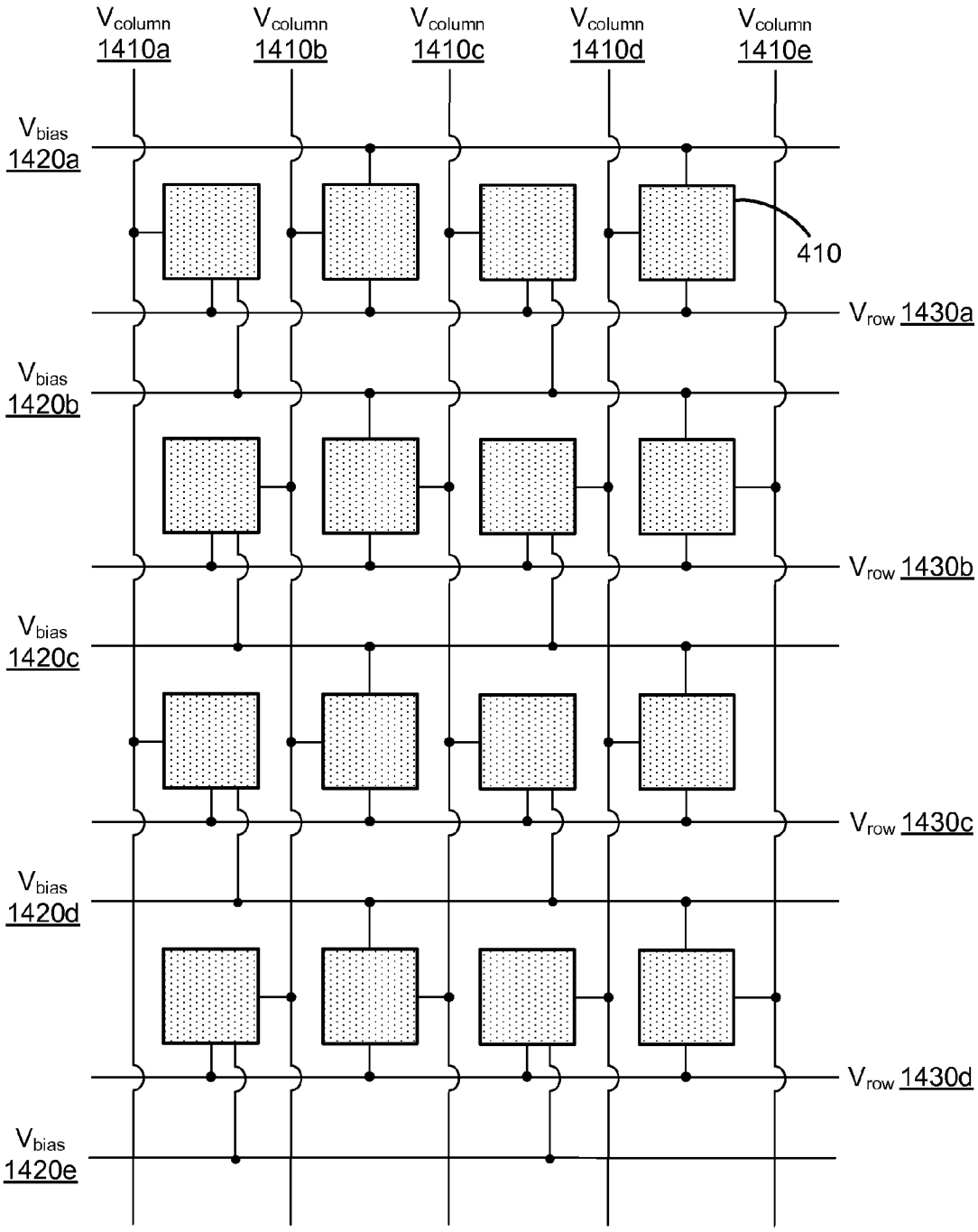
FIG. 14 is a circuit schematic of another example of an IMOD-based display using dot inversion.

FIG. 14 is a circuit schematic of another example of an IMOD-based display using dot inversion of FIG. 13. Unlike the circuit of FIG. 12, the circuit of FIG. 14, $V_{bias}$ electrode 555 and $V_d$ electrode 560 do not need to be disconnected. Additionally, $V_{column}$ 1410*a*-1410*e* do not need to switch in polarity between rows as in the circuit of FIG. 10, and therefore, allows for lower power requirements.

In the circuit of FIG. 14, $V_{column}$ 1410*a*-1410*e* are routed vertically between or among columns of display modules 410. $V_{bias}$ 1420*a*-1420*e* and $V_{row}$ 1430*a*-1430*d* are routed horizontally between or among rows of display modules 410.

$V_{row}$ 1430*a*-1430*d* are coupled to each display module 410 in a particular row. For example, $V_{row}$ 1430*a* is coupled to each display module 410 in the first row. $V_{row}$ 1430*b* is coupled to each display module 410 in the second row. $V_{row}$ 1430*c* is coupled to each display module 410 in the third row. $V_{row}$ 1430*d* is coupled to each display module in the fourth row.

In FIG. 14, $V_{column}$ 1410*a*-1410*e* alternately couple between display modules 410 from two different columns. For example, $V_{column}$ 1410*a* is coupled to the first and third display modules 410 in the first column. $V_{column}$ 1410*b* is coupled to the first and third display modules in the second column and the second and fourth display modules in the first column. Likewise, $V_{column}$ 1410*c*-1410*e* also alternate, or zig-zag, between display modules in different columns.

$V_{bias}$ 1420*a*-1420*e* alternately couple between display modules 410 from two different rows. For example, $V_{bias}$ 1420*a* is coupled to the second and fourth display modules 410 in the first row. $V_{bias}$ 1420*b* is coupled to the first and third display modules 410 in the first row and the second and fourth display modules 410 in the second row. $V_{bias}$ 1420*c* is coupled to the first and third display modules 410 in the second row and the second and fourth display modules 410 in the third row. Likewise, Vbias 1420*d* and Vbias 1420*e* also alternate, or zig-zag, between display modules in different rows.

In some implementations, a physical design, or layout, of the schematic of FIG. 14 may include $V_{column}$ 1410*a*-1410*e* routed in a vertical orientation between or among columns of display modules 410. That is, $V_{column}$ 1410*a*-1410*e* may be routed in a vertical length more than a horizontal length. $V_{bias}$ 1420*a*-1420*e* and $V_{row}$ 1430*a*-1430*d* may be routed in a horizontal orientation between or among rows of display units. That is, $V_{bias}$ 1420*a*-1420*e* and $V_{row}$ 1430*a*-1430*d* may be routed more in a horizontal length than a vertical length. For example, $V_{column}$ 1410*a*-1410*e* may be provided by column driver circuit 26 and $V_{bias}$ 1420*a*-1420*e* and $V_{row}$ 1430*a*-1430*d* may be provided by row driver circuit 24.

Additionally, though routing associated with $V_{com}$ electrode 565 is not shown in FIG. 14, $V_{com}$ electrode 565 for each display unit 450 in the display array may be driven to a fixed voltage (e.g., 0 V). In some implementations, $V_{com}$ electrode 565 for each display module 410 may be coupled to the same interconnect. However, in other implementations, interconnect providing a voltage bias for $V_{com}$ electrode 565 may be routed similar to that of $V_{bias}$ 1420*a*-1420*e*. That is, interconnect associated with $V_{com}$ electrode 565 may also alternately couple to display units like $V_{bias}$ 1420*a*-1420*b*.

Figure 15:
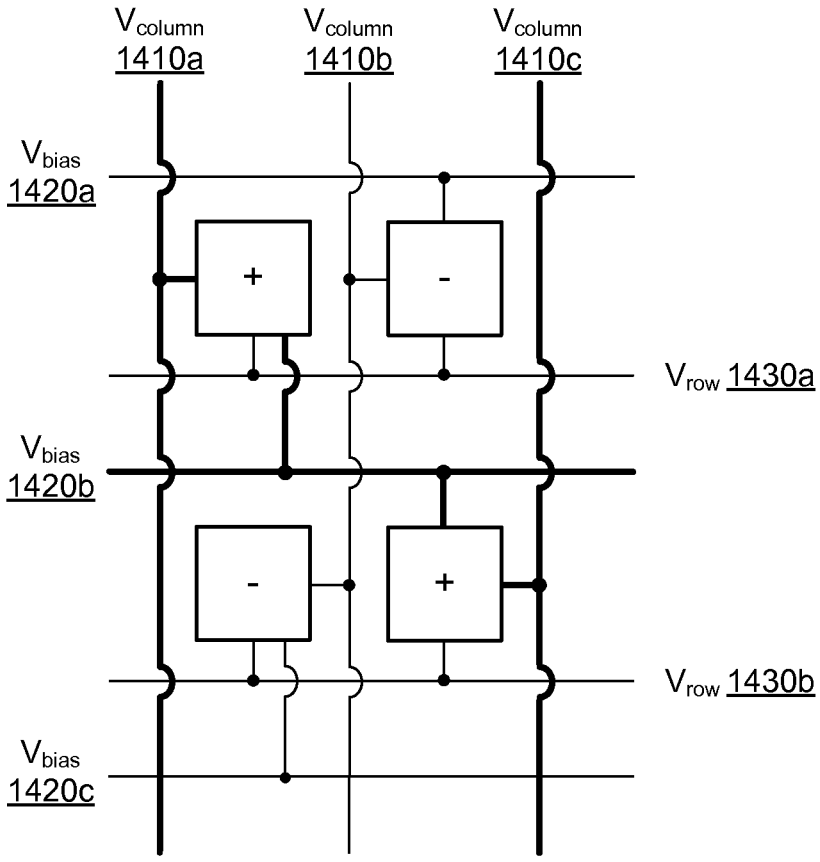
FIG. 15 is a circuit schematic of an example of a 2×2 arrangement of display modules of the circuit of FIG. 14.

FIG. 15 is a circuit schematic of an example of a 2×2 arrangement of display modules of the circuit of FIG. 14. In particular, FIG. 15 portrays the polarities and associated interconnect of display modules 410. The 2×2 arrangement in FIG. 15 is a subset of circuit modules in FIG. 14.

For the 2×2 arrangement in FIG. 15, $V_{column}$ 1410*a* an 1410*c* are and $V_{column}$ coupled to the first display module 410 in the first row and the second display module 410 in the second row, respectively. $V_{bias}$ 1420*b* is coupled to the same display modules 410. The voltages applied to $V_{column}$ 1410*a*, $V_{column}$ 1410*c*, and $V_{bias}$ 1420*b* may be biased to provide a first polarity (e.g., a positive polarity) in a first frame.

$V_{column}$ 1410*b* is coupled to the second display module 410 in the first row and the first display module 410 in the second row. $V_{bias}$ 1420*a* is coupled the second display module 410 in the first row. $V_{bias}$ 1420*c* is coupled to the first display module 410 in the second row. The voltages applied to $V_{column}$ 1410*b*, $V_{bias}$ 1420*a*, and $V_{bias}$ 1420*c* may be biased to provide a second polarity (e.g., a negative polarity) in a first frame. In a subsequent frame, the polarities may be switched.

Figure 16A:
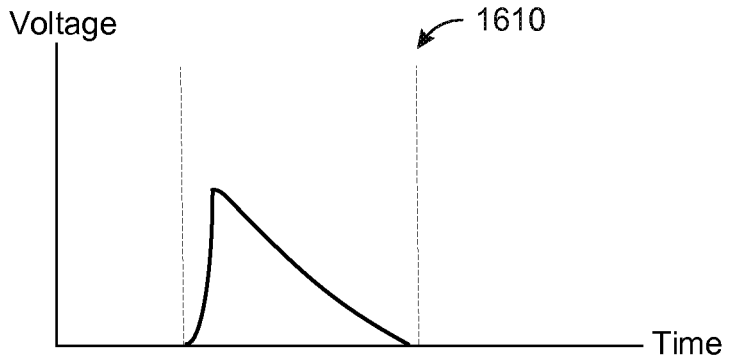
FIGS. 16A and 16B are illustrations of examples of Resistor-Capacitor (RC) delays of an electrode of an IMOD.
Figure 16B:
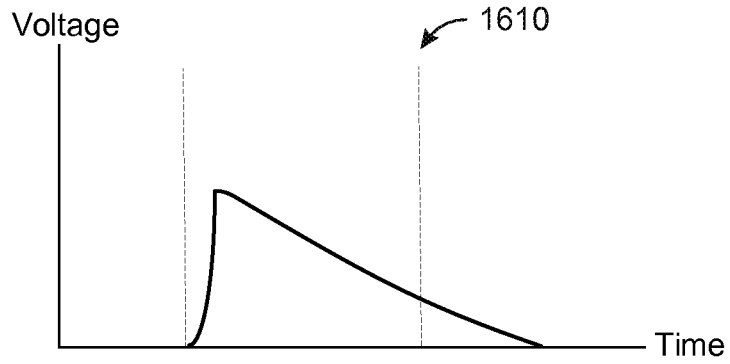

Additionally, Resistor-Capacitor (RC) delays in electrodes of a three terminal IMOD may be problematic. FIGS. 16A and 16B are illustrations of examples of RC delays of an electrode of an IMOD.

In the previous circuits of FIGS. 8, 10, 12, and 14, each row of display modules 410 includes a row select line (i.e., $V_{row}$). The row select lines are coupled to each display module 410 in the respective rows. Accordingly, the IMODs of display modules 410 in the same row are charged at the same time (i.e., $V_d$ electrode 560 is biased). When a three terminal IMOD is charged, the top electrode (i.e., $V_{bias}$ electrode 555) and bottom electrode (i.e., $V_{com}$ electrode 565) are capacitively coupled with the middle electrode (i.e., $V_d$ electrode 560) associated with the mirror of the IMOD. However, the RC delays of the top and bottom electrodes can be high due to the capacitive coupling from each IMOD in the row charging at the same time. If the RC delay is high enough such that the top and/or bottom electrodes retain a higher than expected voltage when the row select line is deasserted, an incorrect voltage may be applied to the mirror.

FIG. 16A portrays a low RC delay for an electrode of an IMOD. In FIG. 16A, at time 1610, a voltage associated with an electrode may be fully discharged.

FIG. 16B portrays a high RC delay for an electrode. In FIG. 16B, the voltage associated with the electrode may take more time to discharge, and therefore, an unexpected voltage value may be on the electrode at time 1610. If, at time 1610, the row select voltage (e.g., $V_{row}$ 530 in FIG. 5) is deasserted to disconnect $V_d$ electrode 560 from $V_{column}$ 520, the charge on $V_d$ electrode 560 may deviate from the expected value, and therefore, the mirror may move to an incorrect position due to the unexpected voltage.

Figure 17:
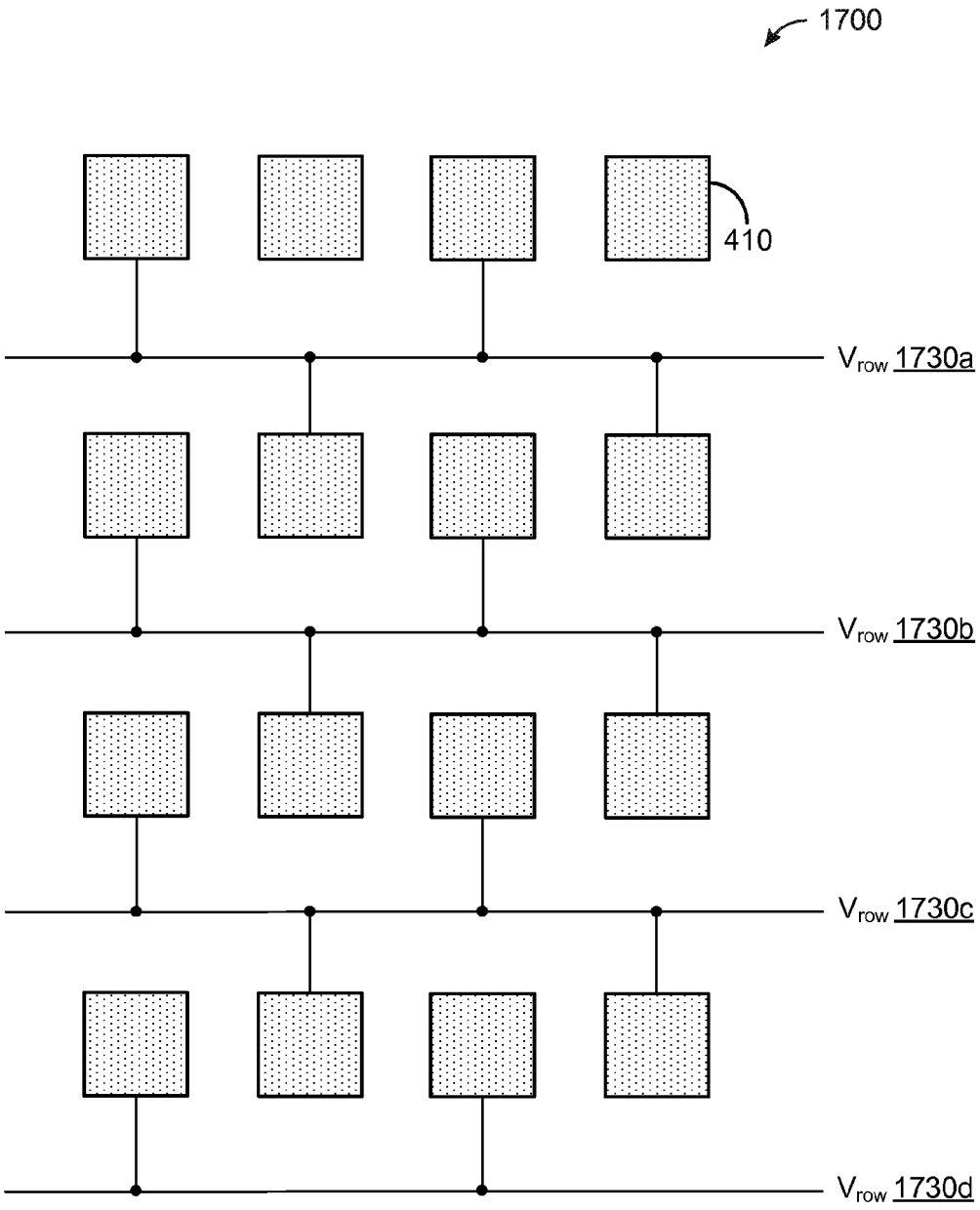
FIG. 17 is a circuit schematic of an example of row select interconnects for an IMOD-based display.

FIG. 17 is a circuit schematic of an example of row select interconnects for an IMOD-based display. In FIG. 17, an array 1700 of display modules 410 includes an arrangement of row select interconnect $V_{row}$ 1730*a*-1730*d* that reduces RC delays for electrodes.

$V_{row}$ 1730*a*-1730*d* alternately couple, or "zig-zag" between display modules 410 between two different rows rather than couple to every display module 410 on the same row (e.g., as in the configurations of FIGS. 8, 10, 12, and 14). For example, $V_{row}$ 1730*a* is coupled with the first and third display modules 410 in the first row and the second and fourth display modules 410 in the second row. $V_{row}$ 1730*b* is coupled to the first and third display modules 410 in the second row and the second and fourth display modules 410 in the third row. $V_{row}$ 1730*c* is coupled to the first and third display modules in the third row and the second and fourth display modules in the fourth row. $V_{row}$ 1730*d* is coupled with the first and third display modules 410 in the fourth row.

Accordingly, when one of $V_{row}$ 1730*a*-1730*b* is asserted, half the number of transistors M1 510 of display modules 410 on the same row are turned on, and therefore, only half the number of $V_d$ electrodes 560 on a row are charged. For example, if $V_{row}$ 1730*a* is asserted, transistors M1 510 of the first and third display module 410 in the first row are turned on. Additionally, transistors M1 510 of the second and fourth display module 410 in the second row are turned on.

Figure 18:
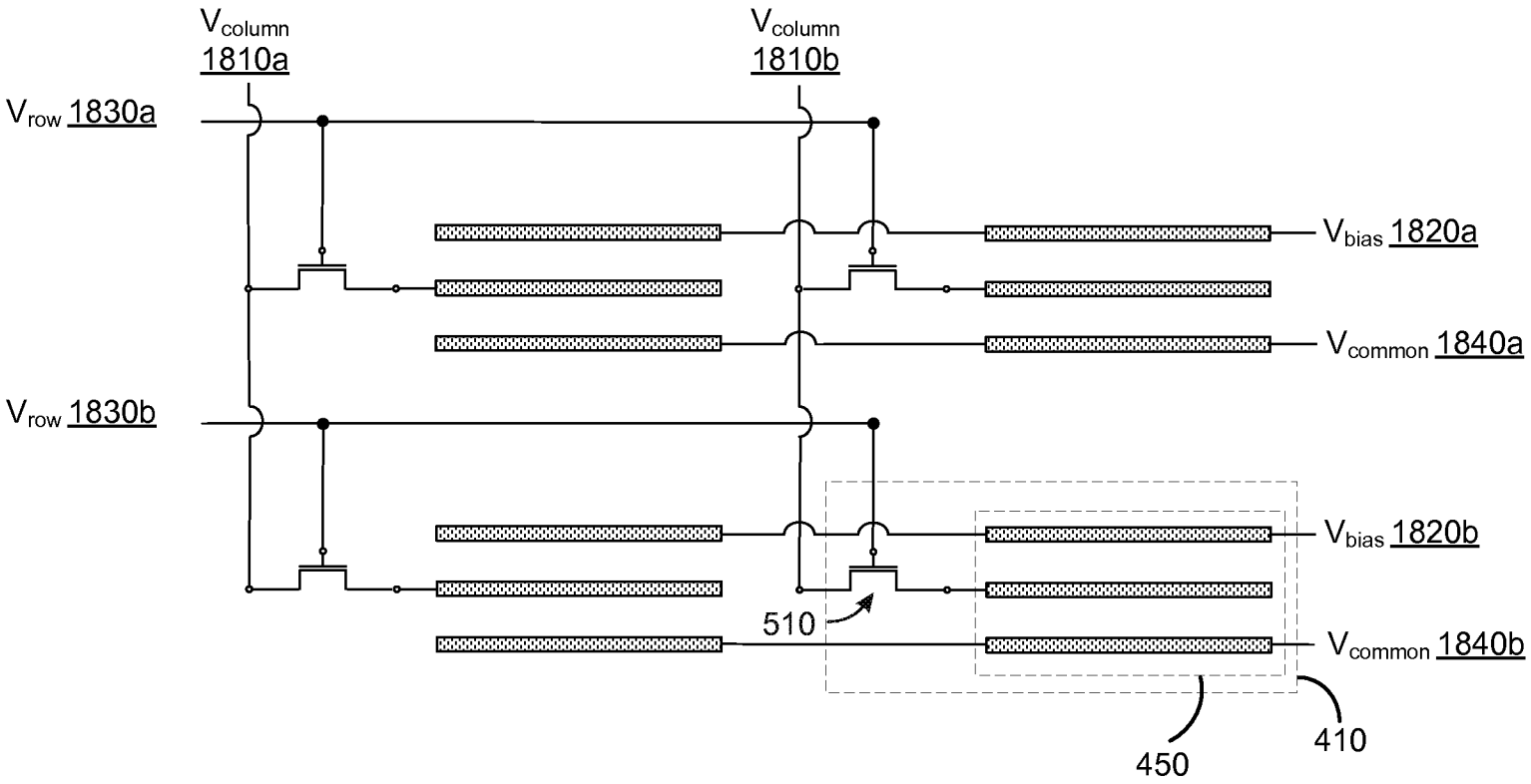
FIG. 18 is a circuit schematic of an example of row select interconnects for an IMOD-based display.

FIG. 18 is a circuit schematic of an example of row select interconnects for an IMOD-based display. The circuit schematic of FIG. 18 includes a 2×2 arrangement of display modules 410. As previously discussed, each display module 410 may include transistor M1 510 and display unit 450 (e.g., a three terminal IMOD). The circuit in FIG. 18 exhibits a high RC delay on the top and bottom electrodes of display unit 410 (i.e., $V_{bias}$ electrode 555 associated with $V_{bias}$ 1820*a* or 1820*b*, and $V_{com}$ electrode 565 associated with $V_{common}$ 1840*a* or 1840*b*).

In FIG. 18, $V_{bias}$ 1820*a* and $V_{common}$ 1840*a* are coupled to electrodes of display unit 450 in the same row. For example, $V_{bias}$ 1820*a* is coupled to the top electrode (i.e., $V_{bias}$ electrode 555) of the first and second display units 450 in the first row. $V_{common}$ 1840*a* is coupled to the bottom electrode (i.e., $V_{com}$ electrode 565) of the first and second display units 450 in the first row.

When a voltage on $V_{row}$ 1830*a* is asserted to turn on transistors 510, the voltage on $V_{column}$ 1810*a* and $V_{column}$ 1810*b* may be applied to the middle electrodes in the first and second display units 450 in the first row, respectively. However, the top and bottom electrodes of display modules 450 in the first row may experience a high capacitive load, and therefore, have a high RC delay associated with FIG. 16A. In particular, because $V_{bias}$ 1820*a* and $V_{common}$ 1840*a* are provided to the electrodes of both display modules 450 in the first row, and $V_{row}$ 1830*a* turns on both transistors M1 550 to apply $V_{column}$ 1810*a* and $V_{column}$ 1810*b* to the middle electrodes of the display units 450 in the first row, a high capacitive load is experienced by the electrodes, and therefore, the RC delay is high.

Figure 19:
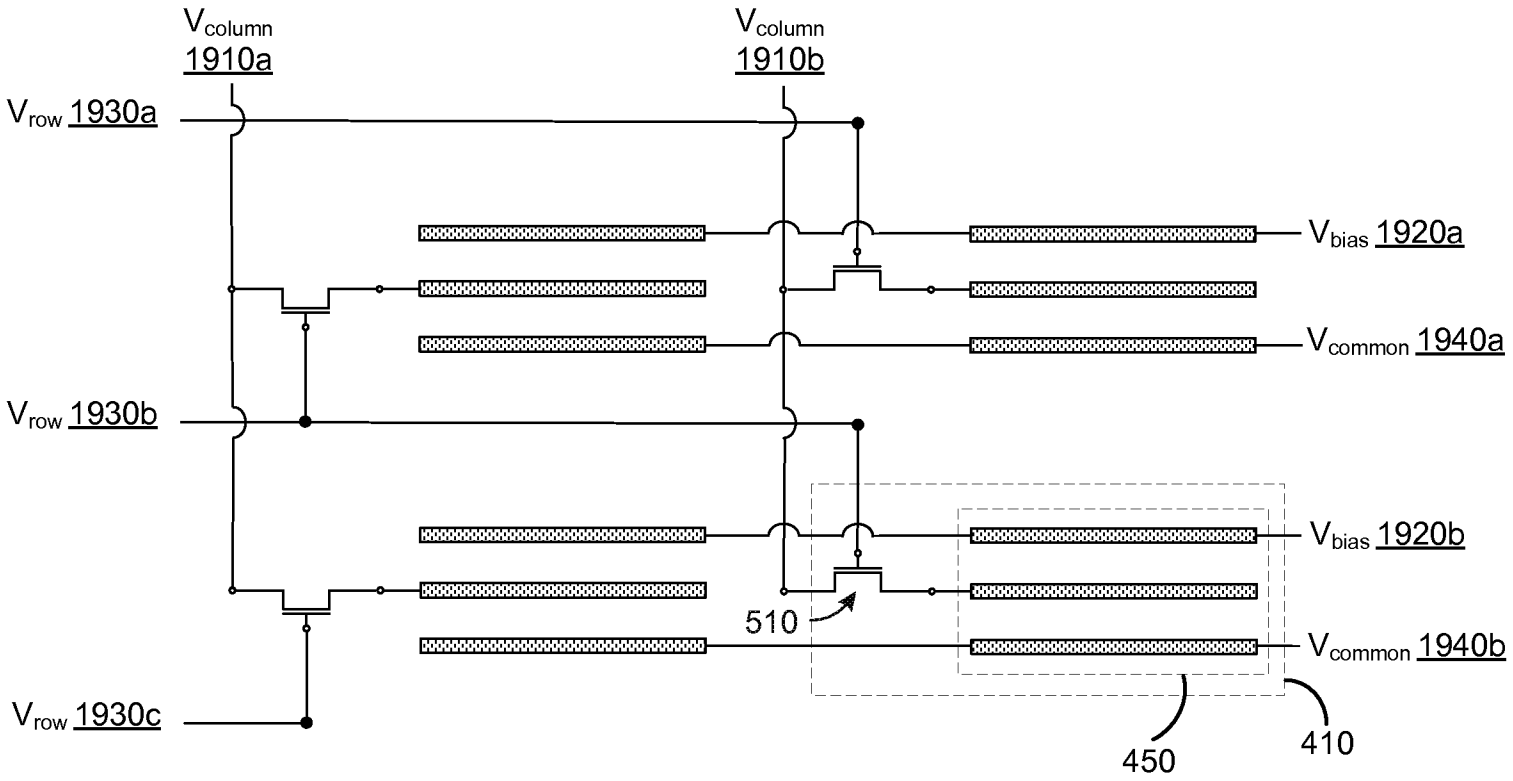
FIG. 19 is a circuit schematic of an example of row select interconnects for an IMOD-based display.

FIG. 19 is a circuit schematic of an example of row select interconnects for an IMOD-based display. The circuit schematic of FIG. 19 may experience a lower capacitive load on the electrodes than the circuit of FIG. 18. Accordingly, the circuit schematic of FIG. 19 may be associated with the RC delay of FIG. 16B.

In FIG. 19, $V_{row}$ 1930*a*-1930*c* are routed as in the schematic of FIG. 17. That is, each $V_{row}$ 1930*a*-1930*c* alternately couples between transistors M1 550 of different display modules 410 in different rows.

As an example, $V_{row}$ 1930*b* may be asserted to turn on transistors M1 550 of the first display module 410 in the first row and the second display module 410 in the second row. Accordingly, $V_{column}$ 1910*a* may be applied to the middle electrode of the first display module 410 in the first row. $V_{column}$ 1910*b* may be applied to the middle electrode of the second display module 410 in the second row. The other transistors M1 550 are turned off because $V_{row}$ 1930*a*-1930*c* are turned on one at a time.

As such, the load capacitance experienced by the top and bottom electrodes of the first display module 410 in the first row and the second display module 410 in the second row is lower because only half of the electrodes sharing the same $V_{bias}$ or $V_{common}$ interconnect are associated with a charged middle electrode.

Figure 20:
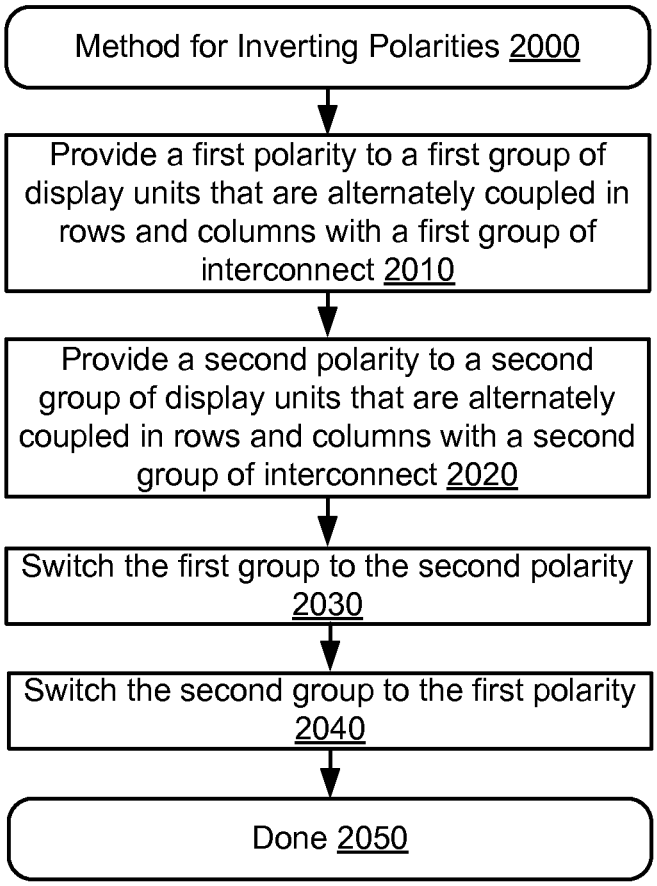
FIG. 20 is a flow diagram illustration a method for providing polarities in a dot inversion configuration.

FIG. 20 is a flow diagram illustrating a method for providing polarities in a dot inversion configuration. In method 2000, at block 2010, voltages may be provided to electrodes, for example, of a first group of display units (e.g., three-terminal IMOD devices), in order to provide a first polarity. In particular, the display units may alternately couple with a variety of interconnect among rows and columns. For example, one interconnect may connect to a first display unit in a second column and first row, and couple with a second display unit in a second row and first column. At block 2020, a second group of display units may be provided with a voltage having a second polarity. For example, the first polarity may be associated with electric fields of the display unit in certain directions. The second polarity may be associated with the electric fields in the display unit in different directions than the display units associated with the first polarity, as previously discussed. Additionally, the display units may also be alternately coupled with a variety of interconnects. At block 2030, the first group may be configured to switch in polarity from the first polarity to the second polarity. At block 2040, the second group may be configured to switch in polarity from the second polarity to the first polarity. The method ends at block 2050.

Figure 21A:
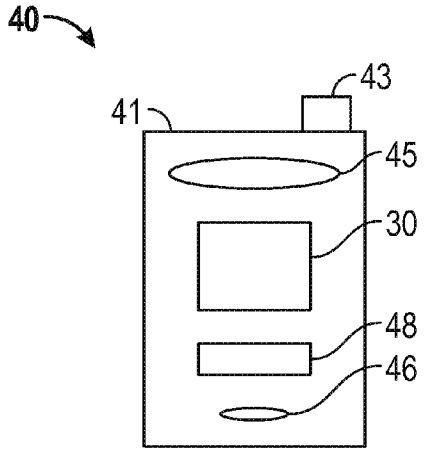
FIGS. 21A and 21B are system block diagrams illustrating a display device that includes a plurality of IMOD display elements.
Figure 21B:
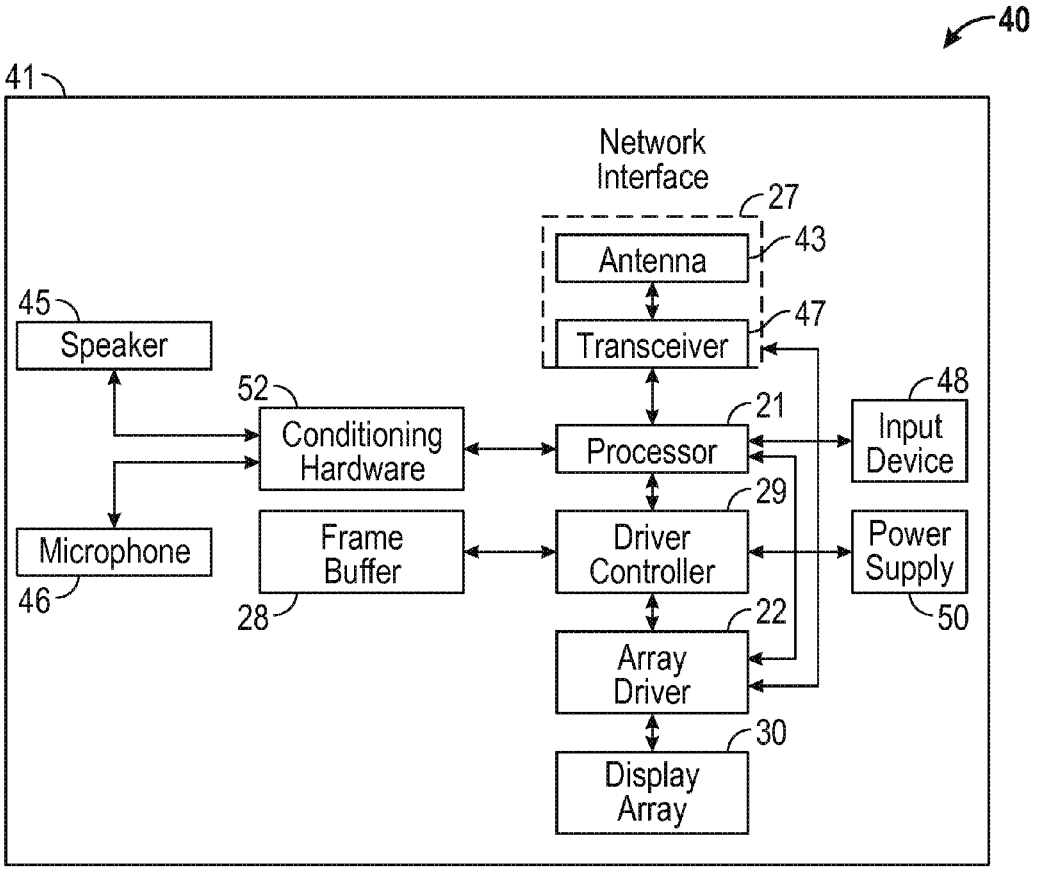

FIGS. 21A and 21B are system block diagrams illustrating a display device 40 that includes a plurality of IMOD display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an IMOD-based display, as described herein.

The components of the display device 40 are schematically illustrated in Figure [#LA]. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 21A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements.

In some implementations, the driver controller 29, the array driver 22, and the display array 30 are appropriate for any of the types of displays described herein. For example, the driver controller 29 can be a conventional display controller or a bi-stable display controller (such as an IMOD display element controller). Additionally, the array driver 22 can be a conventional driver or a bi-stable display driver (such as an IMOD display element driver). Moreover, the display array 30 can be a conventional display array or a bi-stable display array (such as a display including an array of IMOD display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of, e.g., an IMOD display element as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, a person having ordinary skill in the art will readily recognize that such operations need not be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A circuit including an array of display units, the circuit comprising:

a first three-terminal display unit having a first terminal, and a second terminal, and a third terminal, the first terminal coupled to a first interconnect, the second terminal coupled to a second interconnect, and the third terminal coupled to a seventh interconnect;

a second three-terminal display unit having a first terminal and, a second terminal, and a third terminal, the first terminal coupled to a third interconnect, the second terminal coupled to a fourth interconnect, and the third terminal coupled to the seventh interconnect;

a third three-terminal display unit having a first terminal, and a second terminal, and a third terminal, the first terminal coupled to a fifth interconnect, the second terminal coupled to the fourth interconnect, and the third terminal coupled to the seventh interconnect; and a fourth three-terminal display unit having a first terminal, and a second terminal, and a third terminal, the first terminal coupled to the first interconnect, the second terminal coupled to a sixth interconnect, and the third terminal coupled to the seventh interconnect, each of the second terminals of the display units corresponding to movable element electrodes positioned between first and second electrodes corresponding to the first and third terminals of the display units, respectively, the interconnects configured to provide voltages to generate electric fields between the first electrode and movable element electrode and electric fields between the second electrode and movable element electrode such that the first and fourth display units are at a first polarity and the second and third display units are at a second polarity opposing the first polarity.

2. The circuit of claim 1, wherein the seventh interconnect is configured to provide a fixed voltage.

3. The circuit of claim 1, wherein the first interconnect, the third interconnect, and the fifth interconnect are in a first orientation, and the second interconnect, the fourth interconnect, and the sixth interconnect are in a second orientation.

4. The circuit of claim 3, wherein the first and fourth display units are configured to switch to the second polarity, and wherein the second and third display units are configured to switch to the first polarity.

5. The circuit of claim 1, further comprising:

an eighth interconnect coupled to a control terminal of a first switch associated with the first display unit, and further coupled to a control terminal of a second switch associated with the second display unit; and a ninth interconnect coupled to a control terminal of a third switch associated with the third display unit, and further coupled to a control terminal of a fourth switch associated with the fourth display unit.

6. The circuit of claim 1, further comprising:

an eighth interconnect coupled to a control terminal of a first switch associated with the second display unit;

a ninth interconnect coupled to a control terminal of a second switch associated with the first display unit and, the eighth interconnect also being coupled to a control terminal of a third switch associated with the fourth display unit; and a tenth interconnect coupled to a control terminal of a fourth switch associated with the third display unit.

7. The circuit of claim 6, wherein the first display unit is positioned in a first row of the array of display unit, and wherein the fourth display unit is positioned in a second row.

8. The circuit of claim 1, wherein the three-terminal display units are interferometric modulators (IMODs).

9. The circuit of claim 1, wherein the first display unit and the second display unit are positioned in a first row of the array of display units, and wherein the third display unit and the fourth display unit are positioned in a second row.

10. The circuit of claim 9, wherein the first display unit and the third display unit are positioned in a first column, and wherein the second display unit and the fourth display unit are positioned in a second column.

11. The circuit of claim 1, further comprising:

a display including the array of display units;

a processor that is configured to communicate with the display, the processor being configured to process image data; and a memory device that is configured to communicate with the processor.

12. The circuit of claim 1, further comprising:

a driver circuit configured to send at least one signal to the display; and a controller configured to send at least a portion of the image data to the driver circuit.

13. The circuit of claim 1, further comprising:

an image source module configured to send the image data to the processor, wherein the image source module comprises at least one of a receiver, transceiver, and transmitter.

14. The circuit of claim 1, further comprising:

an input device configured to receive input data and to communicate the input data to the processor.

15. A circuit including an array of display modules, the circuit comprising:

a first display module having a first terminal, a second terminal, a third terminal, and a fourth terminal, the first terminal coupled to a first interconnect, the second terminal coupled to a second interconnect, the third terminal coupled to a seventh interconnect, and the fourth terminal coupled with a ninth interconnect;

a second display module having a first terminal, a second terminal, a third terminal, and a fourth terminal, the first terminal coupled to a third interconnect, the second terminal coupled to a fourth interconnect, the third terminal coupled to an eighth interconnect, and the fourth terminal coupled with the ninth interconnect;

a third display module having a first terminal, a second terminal, a third terminal, and a fourth terminal, the first terminal coupled to a fifth interconnect, the second terminal coupled to the fourth interconnect, the third terminal coupled to the eighth interconnect, and the fourth terminal coupled with a ninth interconnect; and a fourth display module having a first terminal, a second terminal, a third terminal, and a fourth terminal, the first terminal coupled to the first interconnect, the second terminal coupled to a sixth interconnect, the third terminal coupled to the seventh interconnect, each of the second terminals of the display units corresponding to movable element electrodes positioned between first and second electrodes corresponding to the first and fourth terminals of the display units, respectively, the interconnects configured to provide voltages to generate electric fields between the first electrode and movable element electrode and electric fields between the second electrode and movable element electrode such that the first and fourth display units are at a first polarity and the second and third display units are at a second polarity opposing the first polarity.

16. A method for inverting polarities of display units in an array of display units, the method comprising:

providing a first voltage having a first polarity to a first group of display units in the array of display units; and providing a second voltage having a second polarity to a second group of display units in the array of display units, wherein the array of display units includes:

a first three-terminal display unit having a first terminal, and a second terminal, and a third terminal, the first terminal coupled to a first interconnect, the second terminal coupled to a second interconnect, and the third terminal coupled to a seventh interconnect, a second three-terminal display unit having a first terminal and, a second terminal, and a third terminal, the first terminal coupled to a third interconnect, the second terminal coupled to a fourth interconnect, and the third terminal coupled to the seventh interconnect, a third three-terminal display unit having a first terminal, and a second terminal, and a third terminal, the first terminal coupled to a fifth interconnect, the second terminal coupled to the fourth interconnect, and the third terminal coupled to the seventh interconnect, and a fourth three-terminal display unit having a first terminal, and a second terminal, and a third terminal, the first terminal coupled to the first interconnect, the second terminal coupled to a sixth interconnect, and the third terminal coupled to the seventh interconnect, each of the second terminals of the display units corresponding to movable element electrodes positioned between first and second electrodes corresponding to the first and third terminals of the display units, respectively, the interconnects configured to provide voltages to generate electric fields between the first electrode and movable element electrode and electric fields between the second electrode and movable element electrode such that the first and fourth display units are at a first polarity and the second and third display units are at a second polarity opposing the first polarity.

17. The method of claim 16, wherein the first display unit and the fourth display unit are associated with the first group of display units, and wherein the second display unit and the third display unit are associated with the second group of display units.

* * * * *